US009599353B2

(12) United States Patent
Cur et al.

(10) Patent No.: US 9,599,353 B2
(45) Date of Patent: Mar. 21, 2017

(54) SPLIT AIR CONDITIONING SYSTEM WITH A SINGLE OUTDOOR UNIT

(71) Applicant: Whirlpool Corporation, Benton Harbor, MI (US)

(72) Inventors: Nihat O. Cur, St. Joseph, MI (US); Timothy A. Kee, Stevensville, MI (US); James W. Kendall, Mt. Prospect, IL (US); Steven J. Kuehl, Stevensville, MI (US); Jeffrey A. Miller, St. Joseph, MI (US); Verne H. Myers, Piscataway, NJ (US); Heng Tong Pit, St. Joseph, MI (US); Guolian Wu, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 355 days.

(21) Appl. No.: 14/266,142

(22) Filed: Apr. 30, 2014

(65) Prior Publication Data

US 2015/0027150 A1 Jan. 29, 2015

Related U.S. Application Data

(60) Provisional application No. 61/859,061, filed on Jul. 26, 2013.

(51) Int. Cl.

| | |
|---|---|
| ***F24F 3/00*** | (2006.01) |
| ***F24F 3/06*** | (2006.01) |
| ***F25B 5/02*** | (2006.01) |
| ***F25B 41/06*** | (2006.01) |
| ***F25B 41/00*** | (2006.01) |
| ***F25B 1/00*** | (2006.01) |
| ***F25B 49/02*** | (2006.01) |
| ***F25D 17/06*** | (2006.01) |
| ***F24F 1/00*** | (2011.01) |

(Continued)

(52) U.S. Cl.

CPC ..... *F24F 3/065* (2013.01); *F24F 1/0003* (2013.01); *F24F 5/0096* (2013.01); *F25B 1/005* (2013.01);

(Continued)

(58) Field of Classification Search

CPC ..... F24F 1/0003; F24F 3/065; F24F 5/0096; F24F 5/02; F24F 41/00; F24F 41/043;

(Continued)

(56) References Cited

U.S. PATENT DOCUMENTS 3,677,028 A 7/1972 Raymond
3,779,031 A 12/1973 Akiyama et al.

(Continued)

FOREIGN PATENT DOCUMENTS

JP 54036649 A 3/1979
JP 60000238 A 1/1985

(Continued)

OTHER PUBLICATIONS

The Inside Story a Guide to Indoor Air Quality (SuDoc DP 1.8:IN 2/3), by U.S. Environmental Protection Agency, Paperback, Jan. 1, 1998, Amazon.com, used $68.95.

*Primary Examiner* — Marc Norman

(57) ABSTRACT

A split air conditioning system for conditioning a plurality of zones within a single living area of a building, that includes a single outdoor unit; a refrigerant flow pathway made up of a plurality of refrigerant conduits having a common refrigerant flow path portion and at least two divergent flow path portions, a first divergent flow path and a second divergent flow path and the first evaporator and second evaporator are in parallel with one another; at least one throttling device; a portioning device configured to selectively and proportionately regulate the flow of a refrigerant fluid to the first evaporator and the second evaporator, respectively where the compressor is configured to be capable of simultaneously driving both the first evaporator and the second evaporator at their full cooling capacity.

21 Claims, 29 Drawing Sheets

(51) Int. Cl.
*F24F 5/00* (2006.01)
*F25B 41/04* (2006.01)
*F25B 6/02* (2006.01)

(52) U.S. Cl.
CPC ..... *F25B 5/02* (2013.01); *F25B 41/00* (2013.01); *F25B 41/043* (2013.01); *F25B 41/062* (2013.01); *F25B 49/02* (2013.01); *F25D 17/06* (2013.01); *F25B 6/02* (2013.01); *F25B 2400/06* (2013.01); *F25B 2400/077* (2013.01); *F25B 2600/21* (2013.01); *F25B 2600/2511* (2013.01); *F25B 2600/2515* (2013.01); *F25B 2700/02* (2013.01); *F25B 2700/135* (2013.01); *F25B 2700/2104* (2013.01); *F25B 2700/2115* (2013.01); *F25B 2700/2117* (2013.01)

(58) Field of Classification Search
CPC . F24F 41/062; F24F 49/02; F25B 5/02; F25B 41/00; F25B 41/043; F25B 41/062; F25B 49/02
USPC ..... 236/1 B; 62/196.1, 196.3, 199, 200
See application file for complete search history.

(56) References Cited

U.S. PATENT DOCUMENTS 4,307,576 A * 12/1981 Takano ..... F25B 5/02 165/207
5,077,982 A 1/1992 Shaffer, Jr.
5,267,450 A * 12/1993 Takegawa ..... F24F 1/0003 62/156
5,467,606 A 11/1995 Sasaka et al.
6,257,014 B1 7/2001 Jao
6,345,667 B1 2/2002 Hata et al.
6,370,908 B1 4/2002 James
6,477,854 B2 11/2002 Chung et al.
6,554,059 B2 4/2003 Hata et al.
6,571,576 B1 * 6/2003 Lifson ..... F04C 29/042 62/196.1
6,672,089 B2 1/2004 Park et al.
6,675,595 B2 1/2004 Ohya
6,826,918 B1 12/2004 Taras et al.
6,868,681 B2 3/2005 Woo et al.
7,418,833 B2 9/2008 Kato et al.
7,441,413 B2 10/2008 Bae et al.
2002/0174673 A1 * 11/2002 Wilkinson ..... F24D 5/12 62/260
2006/0086138 A1 * 4/2006 Park ..... F24F 1/0007 62/428
2007/0227184 A1 10/2007 Son et al.
2012/0031983 A1 2/2012 Shirota et al.
2013/0255307 A1 10/2013 Kuehl et al.
2013/0255309 A1 10/2013 Wu et al.

FOREIGN PATENT DOCUMENTS

JP 6137633 A 5/1994
JP 8303841 A 11/1996
JP 2000213792 A 8/2000
JP 2007040601 A 2/2007

* cited by examiner

SPLIT AIR CONDITIONING SYSTEM WITH A SINGLE OUTDOOR UNIT

CROSS-REFERENCE TO RELATED APPLICATION

This application claims the benefit of U.S. Provisional Patent Application No. 61/859,061, MULTI-ZONE AIR CONDITIONING SYSTEMS WITH MULTIPLE TEMPERATURE ZONES FROM A SINGLE OUTDOOR UNIT, filed Jul. 26, 2013, the disclosure of which is hereby incorporated by reference in its entirety.

BACKGROUND

Air conditioning systems for building structures, dwellings or individual rooms have historically utilized a standard vapor compression cooling system to cool an interior volume of a building structure containing walls and/or ceilings. A traditional home or building air conditioning system is shown schematically in FIG. 1. As shown there, the air conditioning system typically includes an exterior positioned machine compartment housing mounted on a base platform where the housing contains a single outlet, single input compressor, a condenser, and a thermal expansion device. These traditional systems also typically include a fan associated with condenser, the size of which depends on various factors. For whole dwelling/building systems, which the compressor and condenser must provide higher cooling capacity, the systems are sized to match thermal load and are typically larger. Refrigerant fluid conduits deliver refrigerant through the vapor compression system and deliver refrigerant fluid that has passed through the compressor, the condenser and the throttling device to a single evaporator that operates at a single evaporator pressure located within an air passageway within the building structure. The air passageway could be an air duct, air vents of a room air conditioning system or a portion of the building's interior heating, ventilation and air conditioning machine compartment located within the building structure. Typically, the evaporator is positioned within the building's heating ventilation and air conditioning machine compartment. The air passageway typically has an air circulation fan associated with it to distribute air through the building structure or into a portion of the building structure. The air circulation fan delivers air across the single evaporator where it is cooled and the cooled air distributed to the volume of interior air to be cooled. Air is returned to the evaporator. Typically, a building structure may have an exterior air inlet/path that allows exterior air to enter, typically passively enter, the building structure from outside the building structure either directly into the air passageway or into the building structure air where the exterior air is then circulated within the building structure.

While this system does cool the building structure interior it typically does not allow for regulation of both the temperature and humidity of the interior of a building structure. When this traditional air conditioner is used, humidity is removed based upon the temperature of the single evaporator. A person within the interior volume of the building structure might want more or less humidity removed from the air within the building structure than what is allowed by such single evaporator systems.

BRIEF SUMMARY OF THE DISCLOSURE

An aspect of the present disclosure generally includes split air conditioning system for conditioning a plurality of zones within a single living area of a building which may be a single room or open concept/open plan area that makes use of large open spaces such as, for example, a conjoined kitchen and dining room not substantially separated by a wall or walls. The split air conditioning system typically includes: a single outdoor unit having a compressor, a condenser, and a condenser fan associated with the condenser that moves air to cool the condenser; a refrigerant flow pathway with a plurality of refrigerant conduits that form a common refrigerant flow path portion and at least two divergent flow path portions, a first divergent flow path that delivers refrigerant to a first evaporator configured to operate at a first evaporator pressure and a second divergent flow path that delivers refrigerant to a second evaporator such that the first evaporator and second evaporator are in parallel with one another; at least one throttling device where a throttling device is positioned along the common flow path when a single throttling device is used and a first throttling device is positioned along the first divergent flow path and a second throttling device is positioned along the second divergent flow path when two or more throttling devices are employed; a portioning device configured to selectively and proportionately regulate the flow of a refrigerant fluid to the first evaporator and the second evaporator, respectively where the compressor is configured to be capable of simultaneously driving both the first evaporator and the second evaporator at their full cooling capacity. The first evaporator is positioned within a housing of a first indoor air unit positioned within the single living area of the building and the second evaporator is positioned within a housing of a second indoor air unit and both the first and second indoor air units each further may include a fan, typically a variable speed fan, configured to drive air across the first evaporator of the first indoor air unit and across the second evaporator of the second indoor air unit.

Yet another aspect of the present disclosure is generally directed to split air conditioning system for conditioning a plurality of zones within the same interior room of a building. The split air conditioning system typically includes a single outdoor unit having: a housing with a compressor, a condenser, and a condenser fan positioned with the housing wherein the condenser fan is associated with the condenser and configured to move air to cool the condenser. The compressor may be either a dual suction (and typically variable speed) compressor or a single suction compressor with a switching mechanism positioned either external or within a compressor housing that allows for two or more fluid intake conduits to feed into a single suction port of the single suction compressor. The compressor is generally a dual suction, variable speed compressor capable of and configured to deliver full cooling capacity to both a first evaporator and a second evaporator. The system according to an aspect of the present disclosure further typically includes: a refrigerant flow pathway made up of a plurality of refrigerant conduits having a common refrigerant flow path portion and at least two divergent flow path portions, a first divergent flow path that delivers refrigerant to the first evaporator where the first evaporator is configured to operate at a first evaporator pressure and the second divergent flow path that delivers refrigerant to the second evaporator where the second evaporator is configured to operate at a second evaporator pressure and the first evaporator and second evaporator are in parallel with one another; at least two throttling devices where a first throttling device is positioned along the first divergent flow path to receive refrigerant fluid prior to the first evaporator and a second throttling device is positioned along the second divergent flow path to receive refrigerant fluid prior to the second evaporator; a first variable speed fan configured to move air across the first evaporator; a second variable speed fan configured to move air across the second evaporator; a portioning device configured to selectively and proportionately regulate the flow of a refrigerant fluid to the first evaporator and the second evaporator, respectively where the compressor is configured to be capable of simultaneously driving both the first evaporator and the second evaporator at their full cooling capacity and the plurality of refrigerant conduits making up the refrigerant flow path are free of any check valves.

Another aspect of the present disclosure includes a method of conditioning the air within two zones of the same lining area within an interior of the building by: providing a split air system of the present disclosure; adjusting the refrigerant flow through the first divergent flow path and the second divergent flow path using the portioning device, the compressor or both to independently change a cooling capacity of the first evaporator and the second evaporator; adjusting the first variable speed fan to create and adjust the first zone size and a temperature within the first zone based upon user input into the controller or information received by the controller indicating the presence of a person within the first zone; and adjusting the second variable speed fan to create and adjust the second zone size and a temperature within the second zone based upon user input into the controller or information received by the controller indicating the presence of a person within the second zone, wherein the size of the first zone and the size of the second zone are substantially changed by changing the relative volume of air being moved by the first variable speed fan and the second variable speed fan.

These and other features, advantages, and objects of the present disclosure will be further understood and appreciated by those skilled in the art by reference to the following specification, claims, and appended drawings.

BRIEF DESCRIPTION OF THE DRAWINGS

The foregoing summary, as well as the following detailed description of the disclosure, will be better understood when read in conjunction with the appended drawings. For the purpose of illustrating the disclosure, there are shown in the drawings, certain aspect(s) which are presently preferred. It should be understood, however, that the disclosure is not limited to the precise arrangements and instrumentalities shown. Drawings are not necessarily to scale, but relative special relationships are shown and the drawings may be to scale especially where indicated. As such, in the description or as would be apparent to those skilled in the art, certain features of the disclosure may be exaggerated in scale or shown in schematic form in the interest of clarity and conciseness.

DETAILED DESCRIPTION

Figure 1:
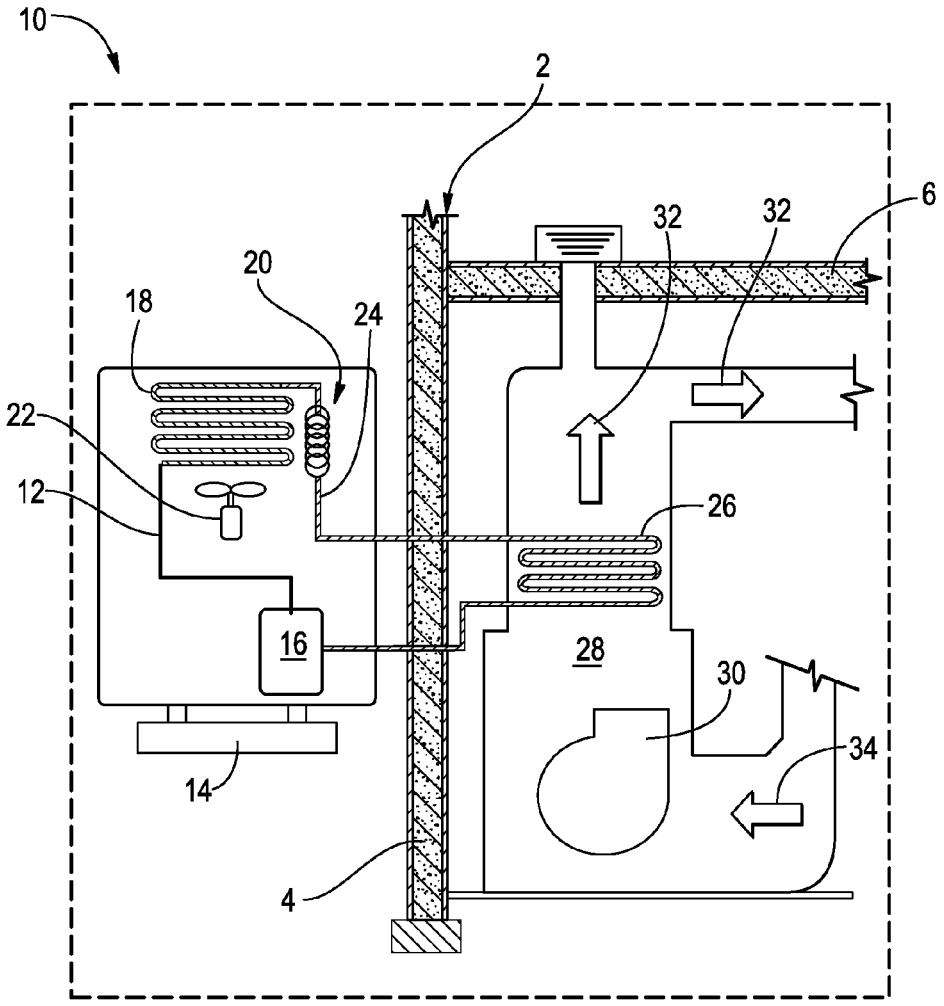
FIG. 1 PRIOR ART
FIG. 1 is a schematic view of traditional air conditioning system employing a single evaporator operating at a single evaporating pressure and a single inlet and single outlet compressor.

Before the subject disclosure is described further, it is to be understood that the disclosure is not limited to the particular aspects of the disclosure described below, as variations of the particular aspects may be made and still fall within the scope of the appended claims. It is also to be understood that the terminology employed is for the purpose of describing particular aspects, and is not intended to be limiting. Instead, the scope of the present disclosure will be established by the appended claims.

Where a range of values is provided, it is understood that each intervening value, to the tenth of the unit of the lower limit unless the context clearly dictates otherwise, between the upper and lower limit of that range, and any other stated or intervening value in that stated range, is encompassed within the disclosure. The upper and lower limits of these smaller ranges may independently be included in the smaller ranges, and are also encompassed within the disclosure, subject to any specifically excluded limit in the stated range. Where the stated range includes one or both of the limits, ranges excluding either or both of those included limits are also included in the disclosure.

In this specification and the appended claims, the singular forms "a," "an" and "the" include plural reference unless the context clearly dictates otherwise.

The present disclosure is generally directed toward improved, more efficient air conditioning systems 110 for building structures 2. The air conditioning systems 110 relate to building structure air conditioning systems 110 that treat the air within all or a portion of the interior of a building structure. The systems discussed herein may be employed as whole building treatment systems, one room air conditioning systems, such as often employed by hotels, and all systems sized in-between. Conceivably, the systems could be used to treat only a portion of a single room. In various aspects, as illustrated in FIGS. 26-35 the air conditioning system 110 can also be used to treat different zones 54, 56 within a single room 52. In such an aspect, an occupant on one side of a room 52 could set the temperature within a first zone 54 comprising a portion of the room 52 at a first temperature, and a second occupant being in a second zone 56 of that room 52 can maintain that second zone 56 at the same temperature, a higher temperature, or a lower temperature, depending upon the preference of the occupants within the various zones 54, 56 of the room 52. Essentially, the systems may be scaled as desired to work to treat whatever volume of internal space within a building structure or room as may be desired.

Figure 2:
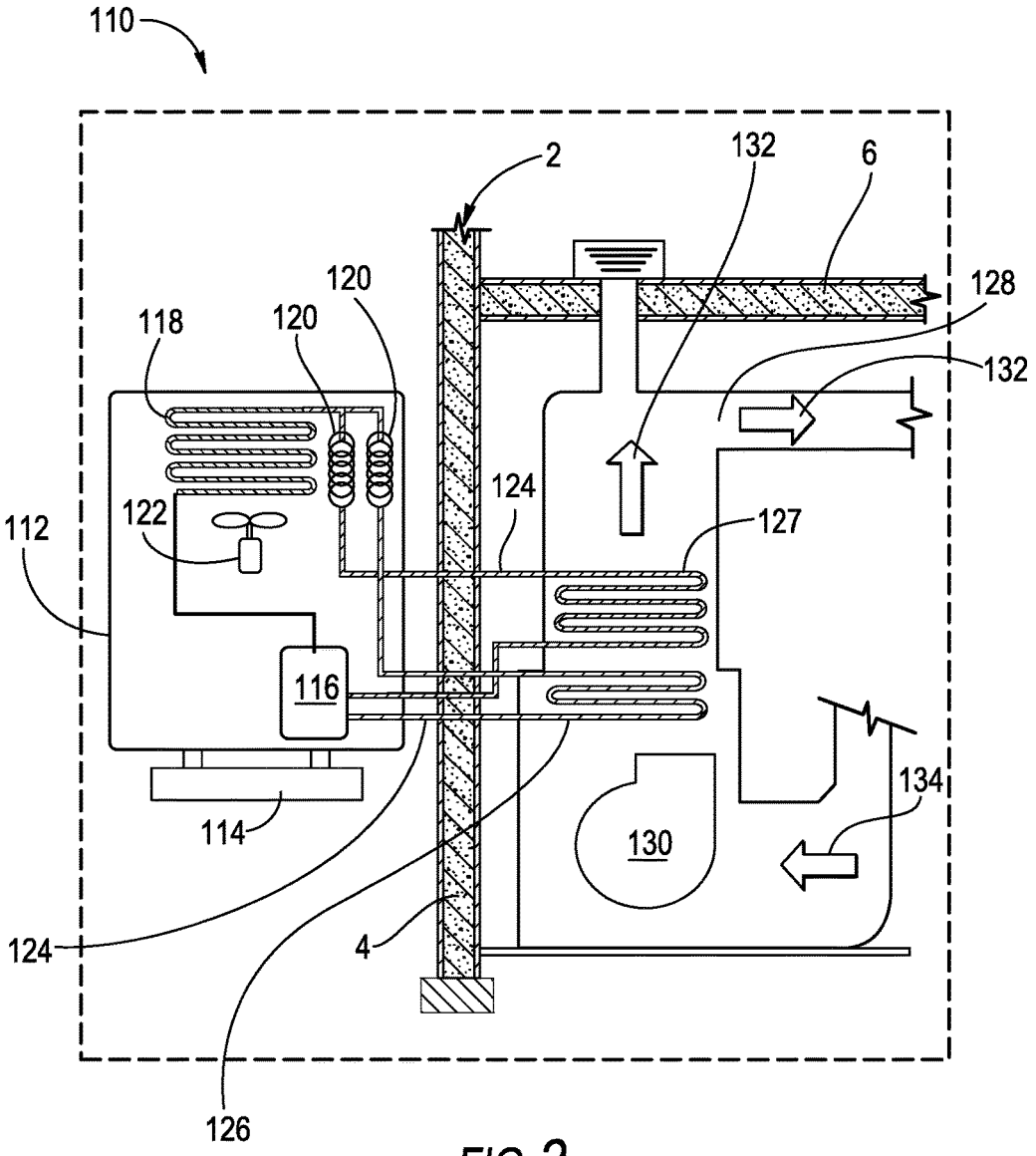
FIG. 2 is a schematic view of an air conditioning system for a building structure according to an aspect of the present disclosure employing a dual suction compressor and two evaporators operating at two different evaporating temperatures.
Figure 24:
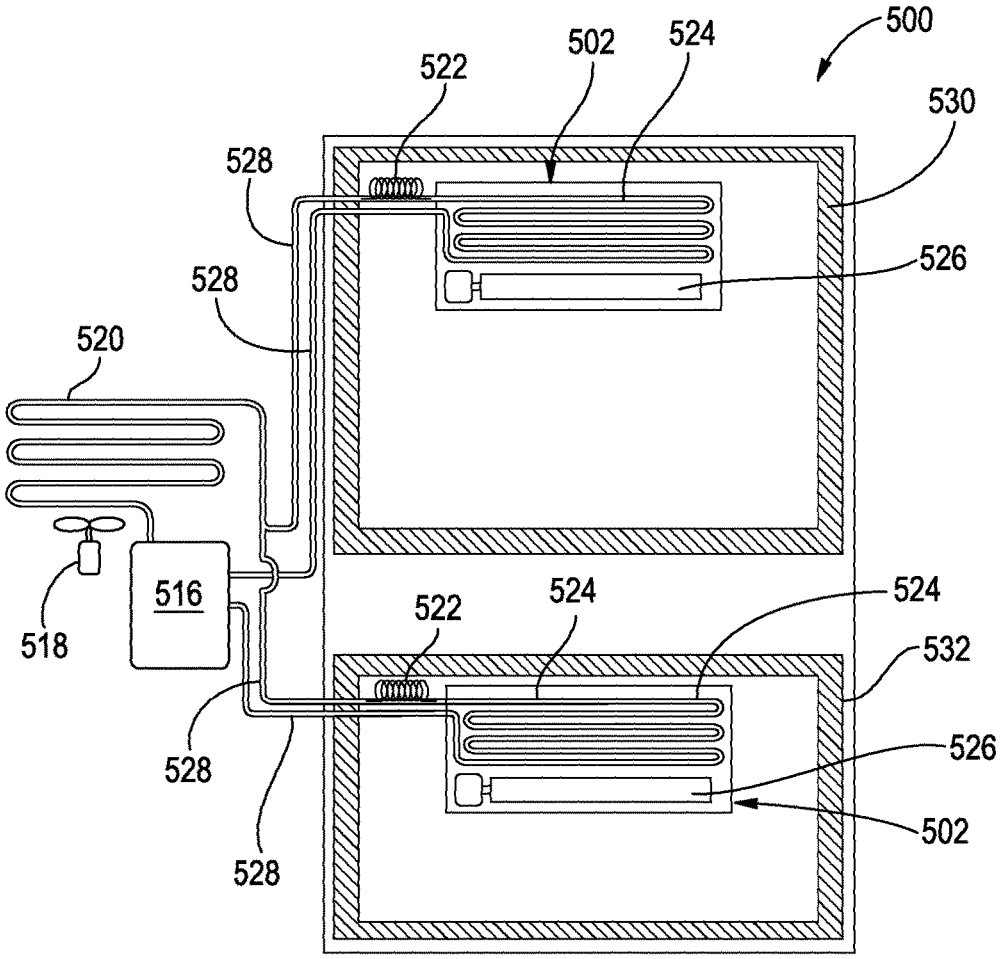
FIG. 24 is a schematic view of a split air conditioning system according to another aspect of the present disclosure.

As shown in FIG. 2, air conditioning systems 110 according to various aspects of the present disclosure for building structures or individual rooms utilize a vapor compression cooling system to cool an interior volume of a building structure 2 that employs a dual suction compressor 116 (FIG. 2), a dual suction—dual discharge compressor 117 (FIG. 16) or a dual discharge compressor 119 (FIG. 24). As shown in FIG. 2, the air conditioning system 110 typically includes an exterior positioned machine compartment housing 112 mounted on a base platform 114 where the housing 112 contains a dual suction compressor 116, a condenser 118, and a number of thermal expansion device 120 that typically matches the number of evaporators of the system. In various aspects, the condenser can be mounted on an exterior wall of a structure, such as a high-rise dwelling or hotel. The air conditioning systems 110 of the present disclosure also typically include one or more fan 122 associated with condenser 118, the size and number of which depends on various factors. For whole building (home) systems that require more cooling capacity, the compressor and condenser must provide the higher cooling capacity, the fan(s) are larger and/or move air at a faster rate to cool the condenser adequately.

Figure 4:
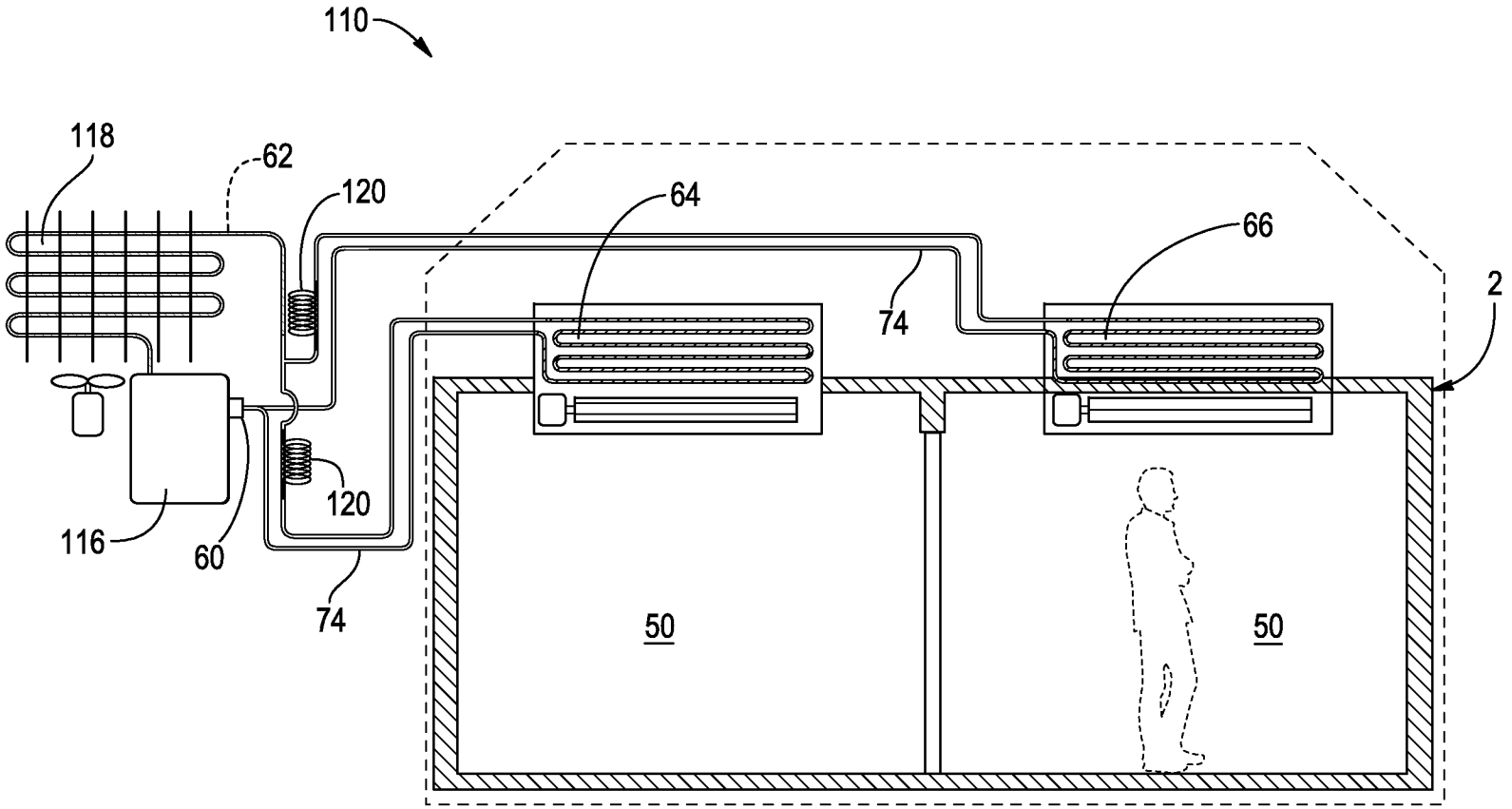
FIG. 4 is a schematic view of an air conditioning system for a building structure according to an aspect of the present disclosure employing a dual suction compressor, two variable temperature evaporators operating at two independent evaporating temperatures and a proportional dual suction valve.
Figure 5:
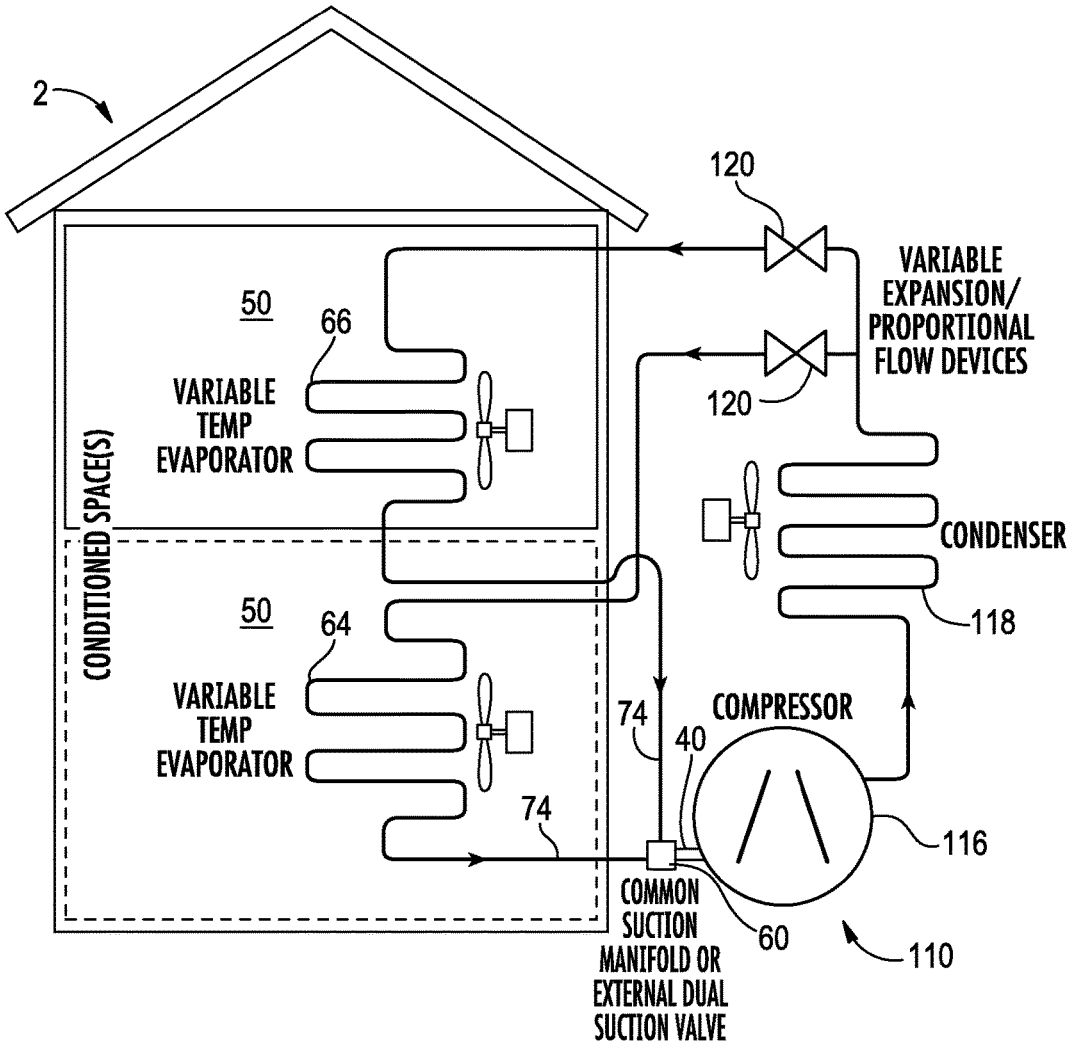
FIG. 5 is a detail schematic view of the air conditioning system of FIG. 4 having a dual suction valve, dual variable expansion devices and variable temperature evaporators serving different volumes within the same building structure.

In various alternate aspects, as illustrated in FIGS. 4-5, the air conditioning system 110 can include a down sized dual-suction compressor 116 that operates at a single speed. The down-sized dual-suction compressor 116 may be such that the overall cooling capacity provided by the down-sized dual-suction compressor 116 is not sufficient to independently cool the entire volume of the building structure 2 at the highest cooling level. However, given the overall construction, the down-sized dual-suction compressor 116 can more efficiently cool the interior volume of a building structure 2 as discussed in more detail herein. In this aspect, a suction valve 60 proportionately regulates the flow of refrigerant 62 through the first and second evaporator circuits 64, 66 of the air conditioning system 110. The suction valve 60 in this aspect operates to regulate vaporized refrigerant 62 flow volume provided on the suction lines 74 of each evaporator 64, 66. Consequently, the suction valve 60 is disposed proximate the compressor 116 where the dual suction lines 74 join to reform the common suction section 40 that runs through the compressor. The dual suction valve 60 can be disposed within a common suction manifold or the dual suction valve 60 can be an external dual suction valve positioned outside the housing. The dual suction valve 60 draws the refrigerant 62 through the evaporators 64, 66 in a controlled manner such that the refrigerant 62 flows through the first and second evaporators 64, 66 at the same rate or at different rates depending on the cooling load required for the respective zones 50 served by the first and second evaporators 64, 66. In this manner, a variable speed compressor is not necessary to provide variable amounts of refrigerant 62 to the various evaporators of the air conditioning system 110.

In operation, temperature and humidity sensors disposed within each of the various zones 50 served by the air conditioning system 110 communicate with the compressor 116, the valve 60, the respective evaporator 64, 66 and other portions of the air conditioning system 110 including an optional computer control system to provide information regarding the status of a particular zone. The status information provided can include temperature, relative humidity and other information related to the comfort level of the particular zone. The air conditioning system 110 uses this status information and the predetermined set points programmed into the system and/or selected by the user of the zone 50 to communicate to the suction valve 60 the proper valve 60 position to sufficiently regulate the flow of refrigerant 62 to each of the evaporators 64, 66 of the system in an efficient manner. Where a zone 50 needs additional cooling or dehumidification, the suction valve 60 changes position to allow a predetermined amount of refrigerant 62 to flow to the evaporator serving that zone to provide the appropriate level of cooling or dehumidification. When the conditions in the zone 50 change such that the space 50 requires more, less or no cooling, or additional dehumidification, the suction valve 60 again changes position to adjust the flow of refrigerant 62 to the evaporators 64, 66 to only that amount necessary to perform the various functions of the air conditioning system 110 as to that particular zone 50.

Figure 36A:
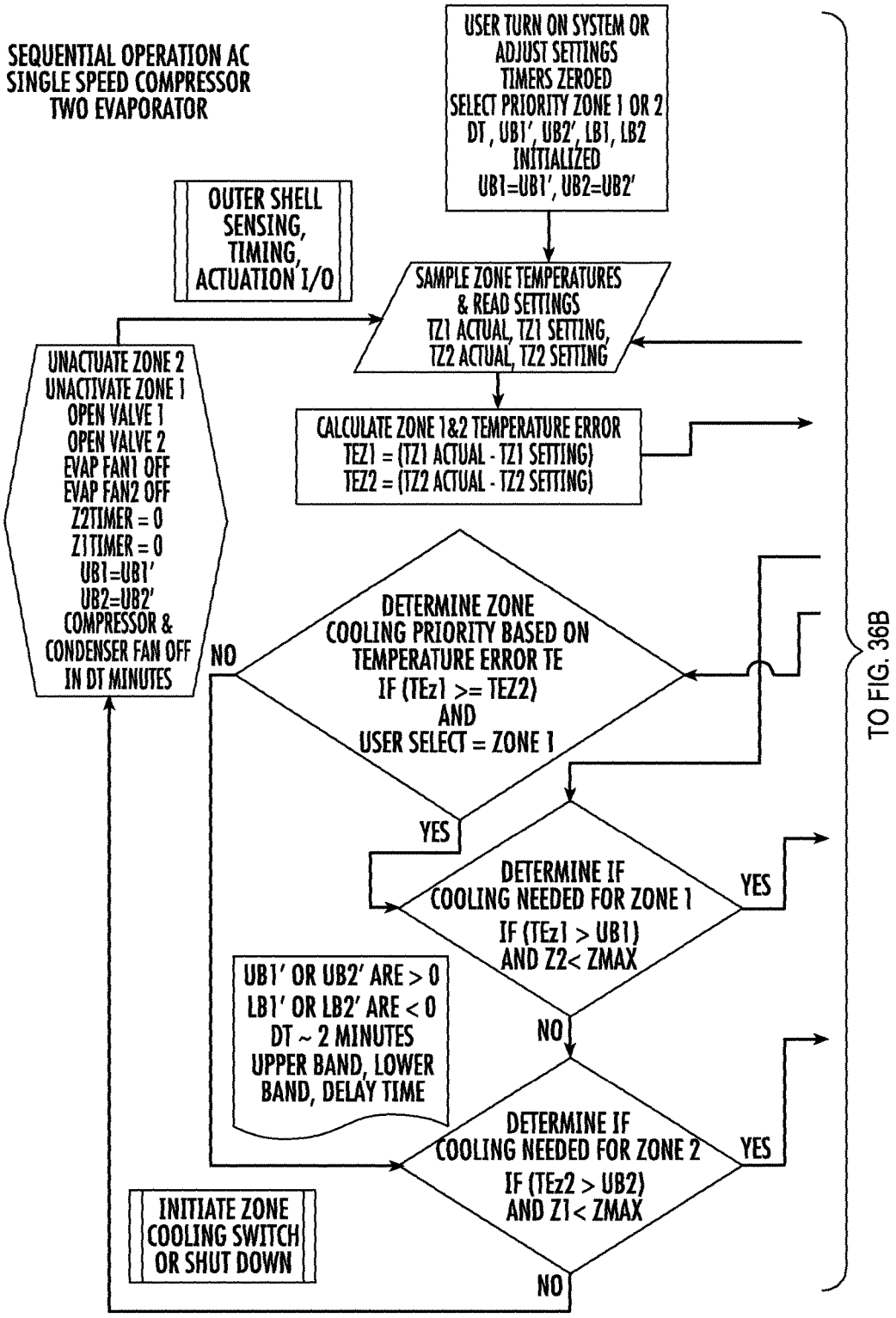
FIGS. 36A and 36B are schematic flow diagrams illustrating a method for operating an air conditioning system utilizing a single-speed compressor and two variable temperature evaporators.
Figure 36B:
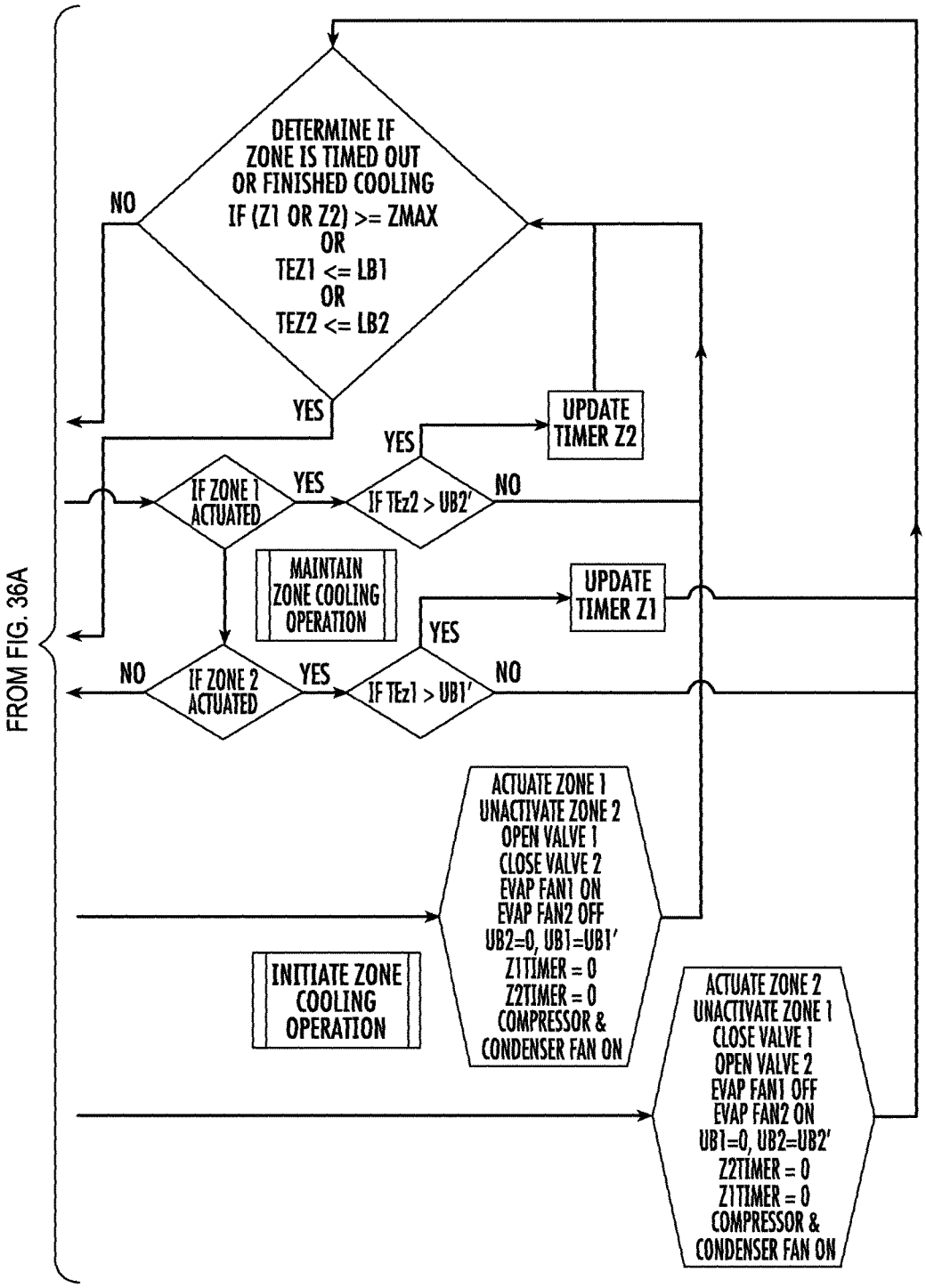

The air conditioning system 110 operates the suction valve 60 in order to match the evaporator temperature with the current room 52 conditions by adjusting the suction valve 60 position to proportionately move refrigerant 62 through the evaporators 64, 66. The flow of refrigerant 62 through the evaporators 64, 66 of the air conditioning system 110 can be simultaneous, where refrigerant 62 can flow through each evaporator 64, 66 simultaneously to cool various zones 50 of the air conditioning system 110 to the same or different temperature and humidity levels. The suction valve 60 can also be configured as sequential such that only one evaporator 64, 66 or a predetermined subset of evaporators is provided with refrigerant 62 at any one time. The operation of this system, the set points and parameters used, and an algorithm that defines the operation of the system are shown in FIG. 36.

Figure 6:
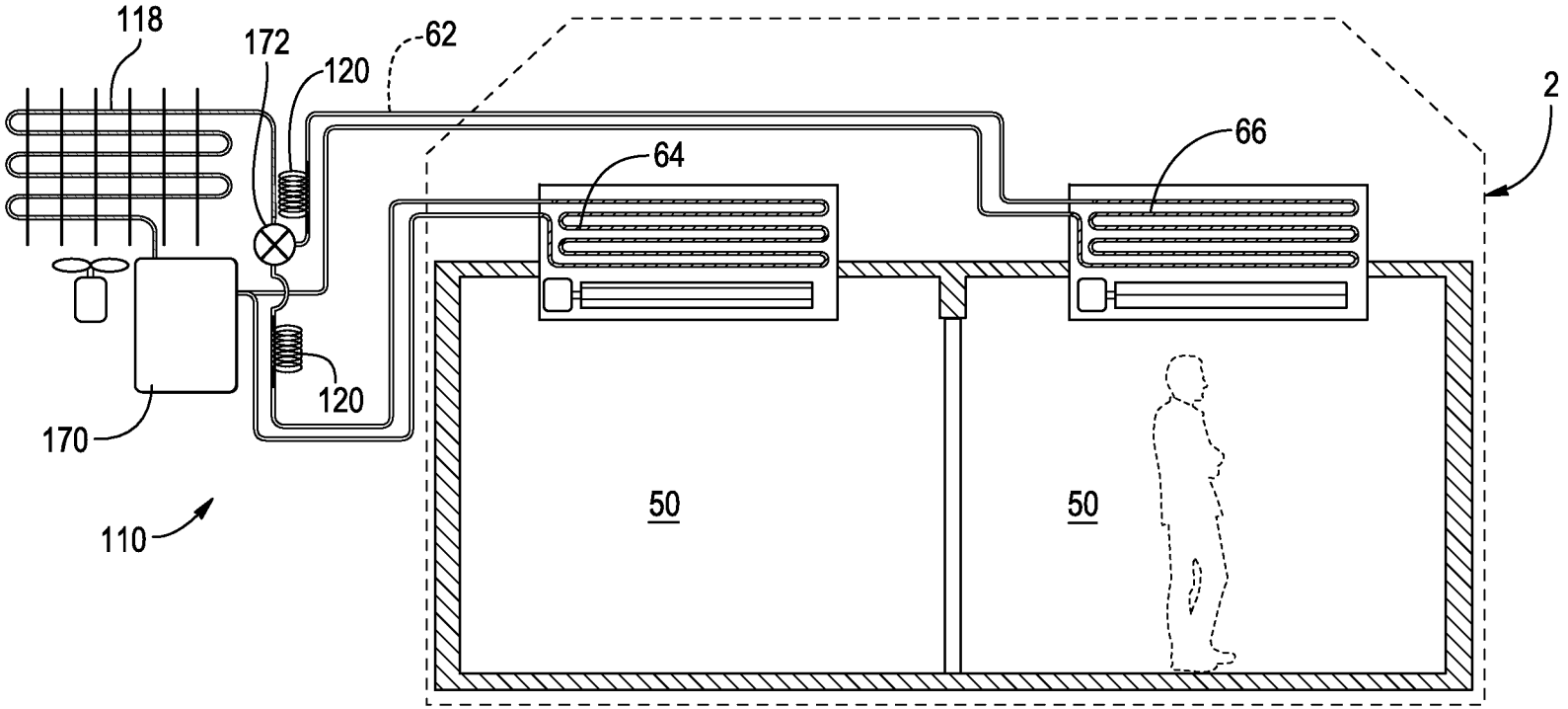
FIG. 6 is a schematic view of an air conditioning system for a building structure according to an aspect of the present disclosure employing a single suction compressor, a proportional fluid refrigerant control valve, dual variable expansion devices, and dual variable temperature evaporators serving different spaces within a structure such as a home.

As illustrated in FIG. 6, in various aspects, a single-suction, single-speed compressor 170 can also be used to provide varying refrigerant 62 flow rates to the first and second evaporators 64, 66 within the air conditioning system 110. In these aspects incorporating a single suction compressor 170, a solenoid valve 172 or series of valves can be disposed between the condenser 118 of the system and various expansion devices 120 of the system. As shown in FIG. 6, the valve is typically a three-way valve, such as a flow splitting valve 68, that regulates refrigerant flow from the condenser 118 to two different expansion devices 120. In various aspects, the valve can also be one of various portioning devices that include, but are not limited to, a three way solenoid, a stepper motor, or other multi-port portioning valve. In this manner, the valve can regulate the flow of liquid refrigerant 62 into each of the expansion devices 120 and onto the respective evaporators 64, 66 of the air conditioning system 110. Because the valve controls the flow of fluid refrigerant 62 to the various evaporators 64, 66 of the system, a single speed compressor can be used to provide varying degrees of refrigerant 62 to multiple evaporators 64, 66 servicing multiple zones 50 within a single building structure 2. Additionally, the various aspects described above allow for the use of smaller sized compressors to provide proportionate amounts of refrigerant 62 to the various evaporators as necessary to precisely and efficiently operate the air conditioning system as described above.

Refrigerant fluid conduits 124 deliver refrigerant through the vapor compression system and deliver refrigerant fluid that has passed through the compressor 116, the condenser 118 and the throttling device 120 to a plurality of evaporators 126, 127 (two are shown, but more than two could conceivably be employed and even greater efficiencies obtained) that operate within an air passageway 128 within the building structure 2. The air passageway could be an air duct, air vents of a room air conditioning system or a portion of the building's interior heating, ventilation and air conditioning machine compartment located within the building structure 2. Typically, the evaporators 126 and 127 are positioned proximate the building's heating ventilation and air conditioning machine compartment or within a portion of it. Significantly, in the various aspects, the air conditioning system 110 is typically free of any check valves disposed in the suction lines 74 between the two evaporators 64. 66. The air passageway 128 typically has an air circulation fan 130 associated with it to distribute air through the building structure 2 or into a portion of the building structure when the air conditioning system 110 treats a single room or an area smaller than an entire interior volume of a building structure. The air circulation fan delivers air across the evaporators 126, 127 where the air is cooled at two different evaporator temperatures and the cooled air 132 is distributed to the volume of interior air to be cooled within the building structure. Air is returned to the evaporator as shown by reference numeral 134. Typically, a building structure may have an exterior air inlet/path that allows exterior air to enter, typically passively enter, the building structure from outside the building structure either directly into the air passageway 128 or into the building structure air where the exterior air is then circulated within the building structure.

Figure 7:
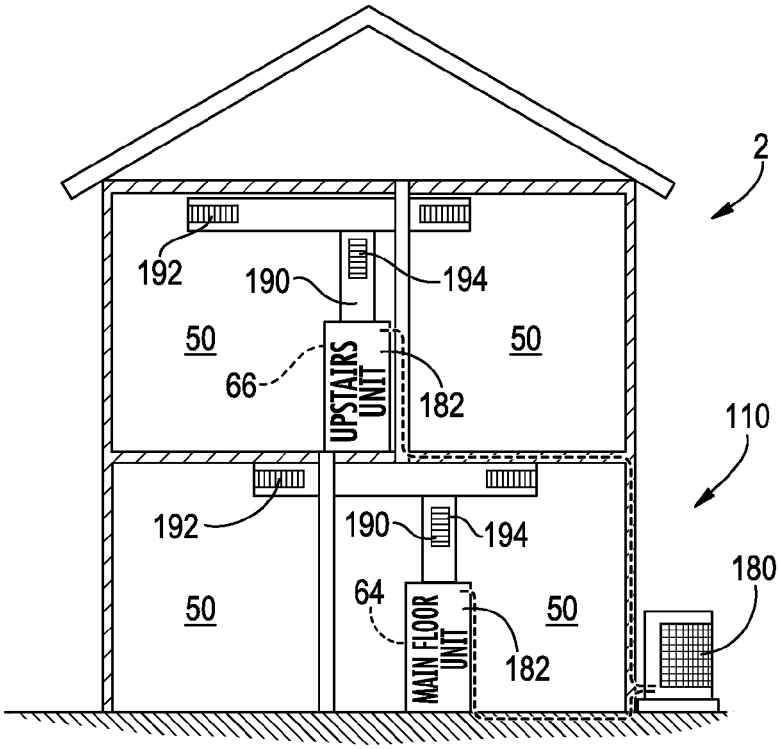
FIG. 7 is a schematic view of a central air conditioning system for a building structure according to an aspect of the present disclosure employing a single outdoor unit serving multiple indoor air handling units.
Figure 8:
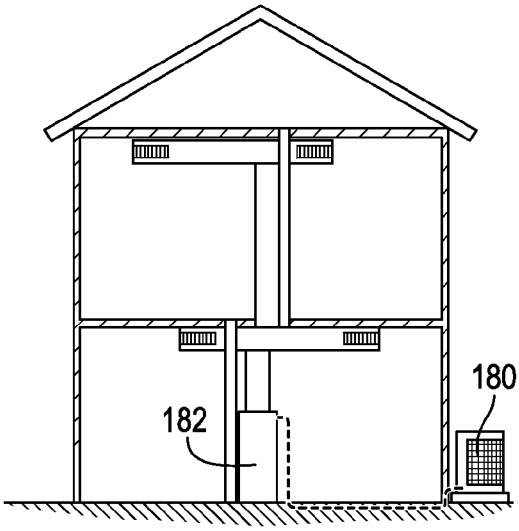
FIG. 8 (PRIOR ART)
FIG. 8 is a schematic view of a traditional central air conditioning system for a building structure employing a single outdoor unit serving a single air handling unit.
Figure 9:
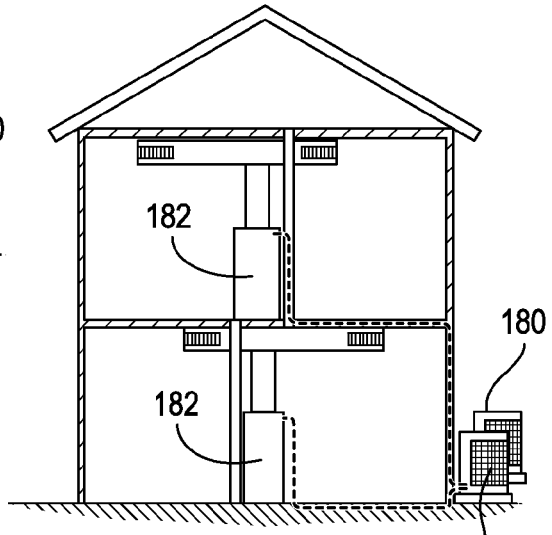
FIG. 9 (PRIOR ART)
FIG. 9 is a schematic view of a traditional central air conditioning system for a building structure employing dual outdoor units each independently serving its own, separate indoor air handling units.

As illustrated in FIG. 7, various aspects of the air conditioning system 110 can utilize a single outdoor air unit 180 and multiple indoor air handling units 182, each of which serve a different zone 50 within the building structure 2. Each of these air handlers 182 can have an independent system of ductwork 190, supply vents 192 and return air vents 194. This lessens the total ducting 190 necessary in home construction and increases efficiency due to less cooling lost to the environment surrounding the ductwork 190. Chilled air is delivered more quickly to the zone 50 within the structure 2 serviced by the indoor air handling unit 182. Within each of these indoor air handlers 182 can be disposed an evaporator 64, 66 that generally provides a single temperature of air throughout that particular zone 50 or space. In still other various aspects, two or more evaporators can be disposed within a single indoor air handler 182 to provide cooling to outside air 34 pulled into the air handler 182, as discussed above. In other various aspects, multiple evaporators can be used to provide cooling to individual subzones within each zone 50 served by the air handler 182. In this manner, various evaporators can be disposed within certain branches of ductwork 190 within an air handling unit 182 to provide various levels of cooling within each subzone. Individual evaporators can also be disposed within the air handling unit 182 to provide significantly improved humidity control as well as temperature control to the air supplied to the zone 50 or subzone served by the air handling unit 182. In previous aspects, two outdoor units were required to serve each individual air handling unit (FIG. 9) or a single outdoor unit served a single air handling unit that requires extensive ductwork throughout the entire structure (FIG. 8). The various aspects disclosed herein allow users to save resources by using a single outdoor unit typically employing a condenser that provides a cooling capacity that efficiently and effectively serves multiple air handling units.

Figure 3:
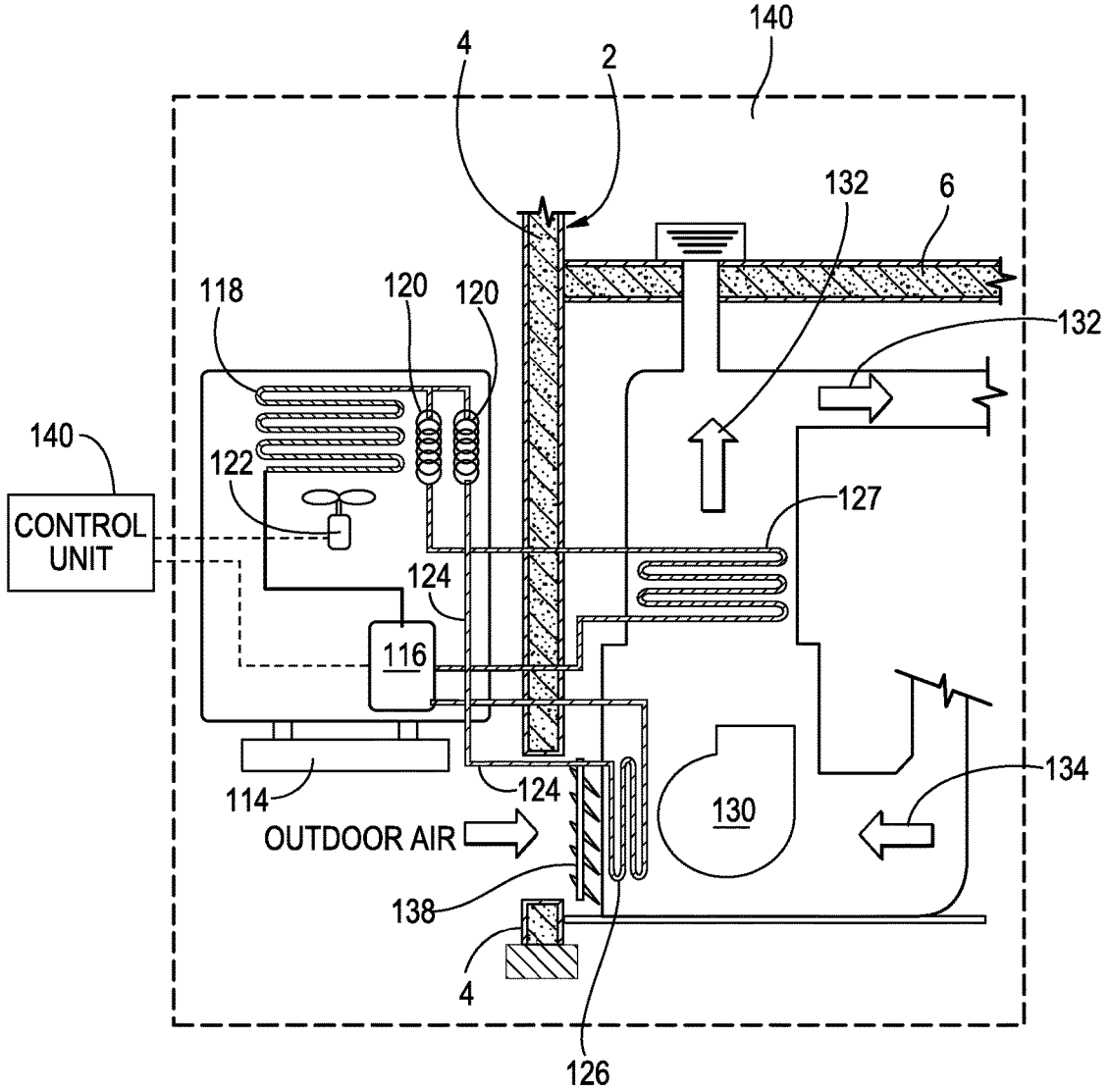
FIG. 3 is a schematic view of an air conditioning system for a building structure according to an aspect of the present disclosure employing a dual suction compressor and two evaporators operating at two different evaporating temperatures with one evaporator treating air taken in from the outdoor air and thereafter into the air passageway of the air conditioning system.

FIG. 3 shows a similar system to FIG. 2; however, the evaporator 126, which is the higher temperature evaporator as discussed more herein, conditions air from outside and allows for greater quantities of external (fresh) air to enter the building structure thereby improving the air quality of the air inside the building structure such as a home. As discussed in the Environmental Protection Agency's publication entitled "*The Inside Story: A Guide to Indoor Air Quality*," outdoor air enters and leaves a house by: infiltration, natural ventilation, and mechanical ventilation. Infiltration describes outdoor air flows into the house through openings, joints, and cracks in walls, floors, and ceilings, and around windows and doors. Air moves through natural ventilation through opened windows and doors. Infiltration and natural ventilation is primarily caused by air temperature differences between indoors and outdoors and by wind. A number of mechanical ventilation devices exist to allow more outdoor air inside such as outdoor-vented fans that intermittently remove air from a single room, such as bathrooms and kitchens, and air handling systems that use fans and duct work to continuously remove indoor air and distribute filtered and conditioned outdoor air to strategic points throughout the house. The rate at which outdoor air replaces indoor air is the air exchange rate. When there is little infiltration, natural ventilation, or mechanical ventilation, the air exchange rate is low and indoor pollutant levels can increase. The present disclosure significantly increases the air exchange rate when the system of FIG. 3 is employed allowing for direct intake of outdoor air into the air conditioning system. Typically, the intake is fluidly coupled to, more typically proximate, a suction side of an air moving device such as a fan. For example, as shown in FIG. 3, the intake is fluidly coupled and proximate the air circulation fan 130, which draws.

The air conditioning system allows for the pretreatment of the outdoor air by the higher temperature evaporator 126. The higher temperature evaporator 126 is typically positioned just inside the building structure proximate one or more vents 138, which can be automatically or manually opened or closed. Instead of venting, louvers or other air closing mechanisms might be employed instead or in addition to the venting. In this manner the air conditioning system regulates and controls the volume of fresh, exterior air supplied to the system and thereby to the interior of the building structure. The addition of more fresh, exterior air from outside the building structure helps improve indoor air quality. The system is typically designed to strike a balance between the amount of fresh air and the energy efficiency. Due to the increased energy efficiency of the present disclosure, for the same amount of energy, the system can introduce fresh air from outside the building structure and therefore improve indoor air quality. Alternatively, energy efficiency may be further enhanced with less fresh, exterior air supplied to the system.

In the context of the present disclosure, a control unit 140 may be in signal communication with each of the components of the air conditioning systems of the present disclosure to dynamically adjust various elements of the system, including the compressor cooling capacity, to maximize energy efficiency. The control unit 140 may optionally receive one or more signals or other input from a user input such as the desired temperature for a given building structure interior volume or, for example, temperature sensors within a building structure or input from the compressor regarding the cooling capacity being supplied by the compressor. The control unit 140, which might be a computer system or processor such as a microprocessor, for example, is typically configured to dynamically adjust the functions of the various types (dual suction, dual suction-dual discharge, and dual discharge) compressors of the present disclosure, including, in the case of FIGS. 2-3, the functioning of the switching mechanism of the dual suction compressor, based upon one or more or all of these inputs to create the most efficient system possible. The control unit 140 also may control the one or more vents 138 between an open and closed position and any position there between and may also regulate the total cooling capacity being supplied by the compressor when the compressor is a variable capacity compressor such as a linear compressor or an oil-less, orientation flexible linear compressor. However, the application more likely will utilize a reciprocating compressor or a scroll compressor, which can be either single or variable capacity. It is also possible to further improve the efficiency of the system by also regulating and varying appropriately the fan(s) and/or compressor cooling capacity modulation through, for example, compressor speed or stroke length in the case of a linear compressor.

The present disclosure includes the use of multiple (dual) evaporator systems that employ a switching mechanism for return of refrigerant to the compressor, where the air conditioning system 10 is free of any suction-line check valves. The switching mechanism allows the system to better match total thermal loads with the cooling capacities provided by the compressor. Generally speaking, the system gains efficiency by employing the switching mechanism, which allows rapid suction port switching, typically on the order of a fraction of a second. The switching mechanism can be switched at a fast pace, typically about 30 seconds or less or exactly 30 seconds or less, more typically about 0.5 seconds or less or exactly 0.5 seconds or less, and most typically about 10 milliseconds or less or exactly 10 milliseconds or less (or any time interval from about 30 seconds or less). As a result, the system rapidly switches between a lower temperature evaporator 127 cooling operation mode and a higher temperature evaporator 126 cooling operation mode. The compressor 112 may be a variable capacity compressor, such as a linear compressor, in particular an oil-less linear compressor, which is an orientation flexible compressor (i.e., it operates in any orientation not just a standard upright position, but also a vertical position and an inverted position, for example). The compressor is typically a dual suction compressor (See FIG. 11) or a single suction compressor (See FIGS. 12-13) with an external switching mechanism. When the compressor is a single suction compressor (FIG. 12-13), it typically provides non-simultaneous dual suction from the refrigerant fluid conduits 144 from the higher temperature air treatment evaporator and the lower temperature air treatment evaporator.

Figure 10A:
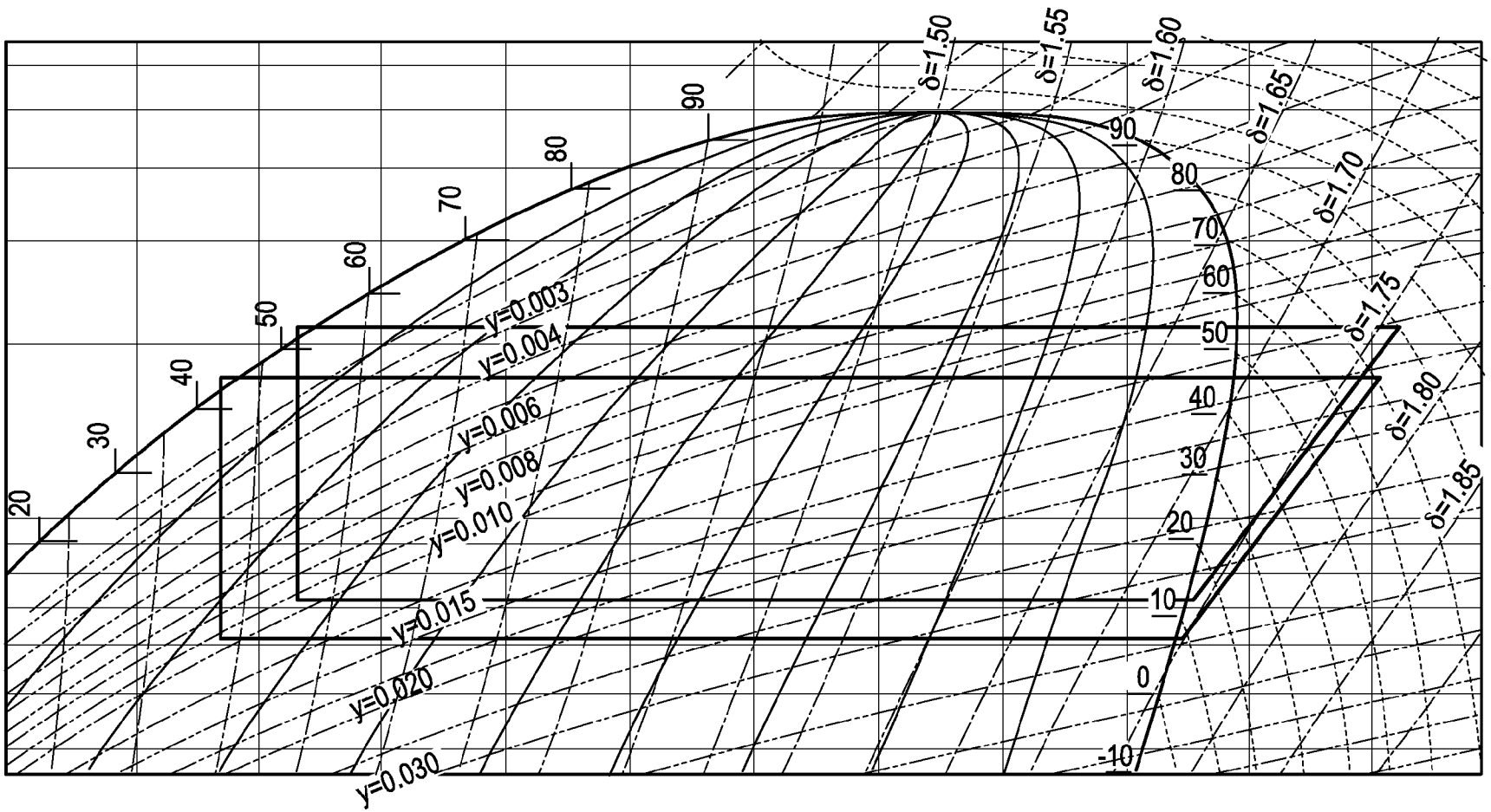
FIG. 10*a* is a thermodynamic cycle of a dual suction and dual discharge compressor containing air treatment system that may be utilized in connection methods of improving efficiency of the air conditioning system according to an aspect of the present disclosure.

As shown in FIGS. 2-3, one aspect of the present disclosure utilizes a sequential, dual evaporator refrigeration system as the air conditioning system 110. The dual evaporator refrigeration system shown in FIG. 2 employs a lower temperature evaporator 127 and a higher temperature evaporator 126 are each fed by refrigerant fluid conduits 124 engaged to two separate expansion devices 120. Due to the evaporating pressure differences cooling the air at different operating temperatures, the evaporators do not continuously feed refrigerant flow to the suction lines simultaneously and thus are activated as cooling is needed at different levels and to regulate the humidity of the air. In this sense, a major advantage of the dual (or multiple) evaporator system is that the higher temperature evaporator runs at a higher temperature than the lower temperature evaporator, thereby increasing the overall coefficient of performance (See FIG. 10*a* for a dual suction/dual discharge compressor and FIG. 10*b* for dual discharge compressor).

In various aspects, the difference in evaporating pressure to the evaporators 64, 66 is primarily influenced by the expansion/restriction provided by the expansion devices 20, and secondarily influenced by the temperature of the zones 50 being served by the respective evaporators 64, 66. In this manner, where there is a large temperature difference between the temperature of the zone 50 and the temperature of the respective evaporator 64, 66, the evaporator 64, 66 automatically transfers larger amounts of cooling into the space being served thereby causing a higher evaporating pressure in the refrigerant lines. This results in the respective evaporator circuit 64, 66 having greater capacity to provide cooling to the zone 50 having a higher temperature. As the temperature of the zone 50 becomes closer to the temperature of the evaporator 64, 66, lesser amounts of cooling will be released by the evaporator 64, 66, thereby decreasing the evaporating pressure. In this manner, the evaporating pressure served to the evaporator 64, 66 can be determined by the actual conditions present within the zone 50 served by the evaporator 64, 66. This control mechanism serves to substantially optimize the efficiency of the compressor 116 such that the air conditioning system 110 tends to maximize the cooling capacity provided by the compressor 116 to optimize the amount of cooling provided to zones 50 that have the greatest load (i.e., the highest temperatures). In other various aspects, the operating pressure and temperature of the evaporator 64, 66 can be controlled by a combination of the room/evaporator temperature differential and the expansion/restriction device resistance as controlled by the positioning of the portioning valve that regulates the proportionate flow of refrigerant 62 through the various evaporator circuits 64, 66.

Because the higher temperature evaporator refrigerant circuit operates at a much higher temperature than the lower temperature evaporator refrigerant circuit operates, the thermodynamic efficiency of the cooling system is improved. For example, assuming that the evaporating temperature is 7.2° C. and the condensing temperature is 54.4° C. and the isoentropic efficiency (including motor efficiency) is 0.6, the COP of the cooling system would be estimated at 2.69. In a dual suction compressor system, assuming the refrigerant circuits are 50% and 50% in terms of heat transfer area and assuming the first circuit operates at an evaporating temperature of 17° C., the first circuit COP is 3.66. The overall COP of the system employing a dual suction system would be (0.5*3.66)+(2.69*0.5)=3.175. This amounts to about an 18% improvement in system COP compared to the conventional single suction compressor system. The analysis assumes that the condensing temperature is the same for both circuits. In fact, the condensing temperature will be higher for dual suction compressor system so the actual COP will be lower than 18%, but significant COP are achieved using such dual suction systems. The overall coefficient of performance is a weighted average of the coefficient of performance of the higher temperature evaporator containing circuit and the lower temperature as follows:

$$COP_{Total}==X*COP_{HTE}+(1-X)*COP_{LTE}$$

"X" is the ratio of high temperature evaporator cooling rate to the total cooling rate the system provides.

As discussed above, the first evaporator may treat the initial air either within the air passageway directly in line with the second evaporator (FIG. 2) or it may be positioned to pre-cool and dehumidify air received from outside the building structure (FIG. 3). The lower temperature evaporator 127, which operates at a lower pressure (colder temperature), may be used to pull more moisture out of the air and thereby regulate humidity in an interior volume of the building structure. Similarly, if the higher temperature evaporator is used more to cool the interior air of the building structure, the humidity level would be higher. There would be less latent cooling and thus less moisture removed from the air.

While the use of two evaporators is the typical configuration of this aspect of the present disclosure, the configuration could conceivably utilize, three, four, or more evaporators positioned at various outdoor air intakes or locations within the air passageways. So long as the lower temperature evaporator circuit is at a lower temperature than the higher temperature evaporator circuit and the average temperature of the two evaporators is warmer than the average temperatures of the air passing through a single evaporator, efficiencies are gained.

An aspect of the present disclosure includes increasing the efficiency of the air conditioning system by rapidly switching between the lower temperature evaporator operation mode and a higher temperature evaporator operation mode. Where T1 is the opening time of the high pressure suction port; T2 is the opening time of the low pressure suction port; T_on is the compressor on time; and the T_off is the compressor off time, by varying T1, T2, T_on and T_off, it is possible to most efficiently meet the total thermal load requirements of the building structure interior volume being cooled with the cooling capacity (fixed or variable) provided by the compressor to thereby increase the overall coefficient of performance of the refrigerant system of the air conditioning system. It is also possible to further improve the efficiency of the system by also regulating and varying appropriately the fan(s) and/or compressor cooling capacity modulation through, for example, compressor speed or stroke length in the case of a linear compressor.

In various aspects, the rapid switching of the flow-splitting valve 68 (shown in FIG. 34) to deliver refrigerant 62 from a single fluid conduit to the first and second evaporator circuits can create a sequential system such that one evaporator circuit is provided with a predetermined flow of refrigerant 62 followed by a predetermined flow of refrigerant 62 to a second evaporator circuit 66. Upon completion of one cooling and/or dehumidification cycle, the flow splitting valve 68 changes position to provide a flow of refrigerant 62 to another evaporator circuit for the duration of that particular cooling and/or dehumidification period. Alternatively, the system of rapidly switching the flow-splitting valve 68 between positions to provide refrigerant 62 to the first evaporator circuit 64 and second evaporator circuit 66 can create a simultaneous air conditioning system. Where the flow-splitting valve 68 is switched rapidly, the flow-splitting valve 68 can provide a quasi-continuous flow of refrigerant 62 to each of the first and second evaporator sections 64, 66, thereby creating an air conditioning system that simultaneously provides refrigerant 62 to multiple evaporators 64, 66. In other various aspects, a simultaneous flow of refrigerant 62 to the various evaporators 64, 66 of the air conditioning system can be provided by one or more valves that can be positioned in an open or semi-open position as to more than one evaporator at the same time such that a proportional and continuous flow of refrigerant 62 is provided to more than one evaporator 64, 66 simultaneously.

Figure 11:
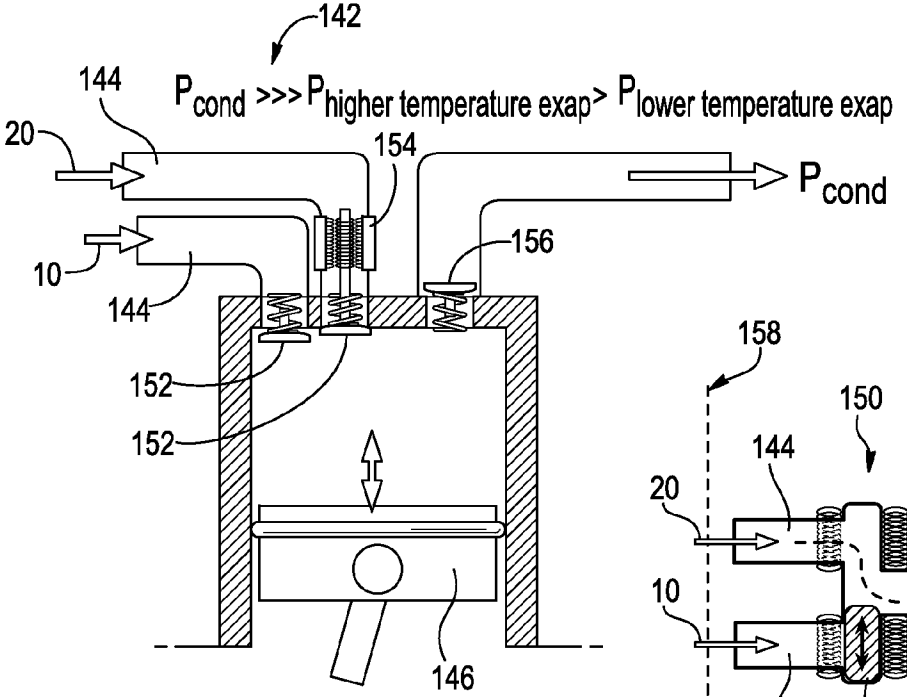
FIG. 11 shows a compressor according to an aspect of the present disclosure showing dual suction.
Figure 12:
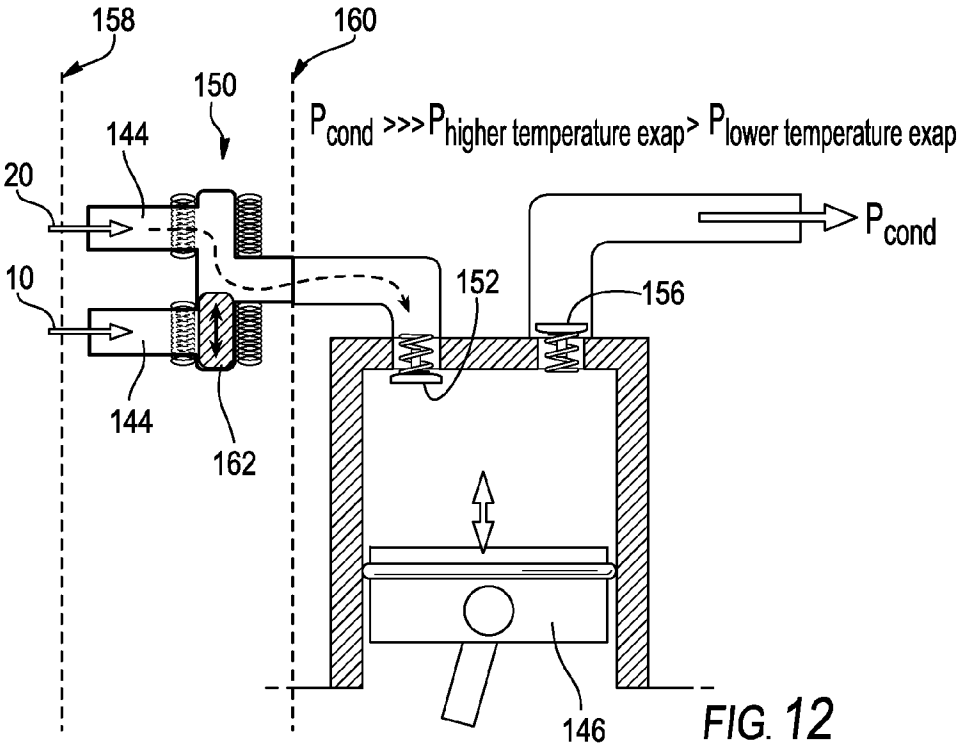
FIG. 12 shows another aspect of a single suction compressor employing a three-way valve either inside the compressor or outside the compressor housing (the housing shown by the dashed line) according to an aspect of the present disclosure enabling dual suction.
Figure 13:
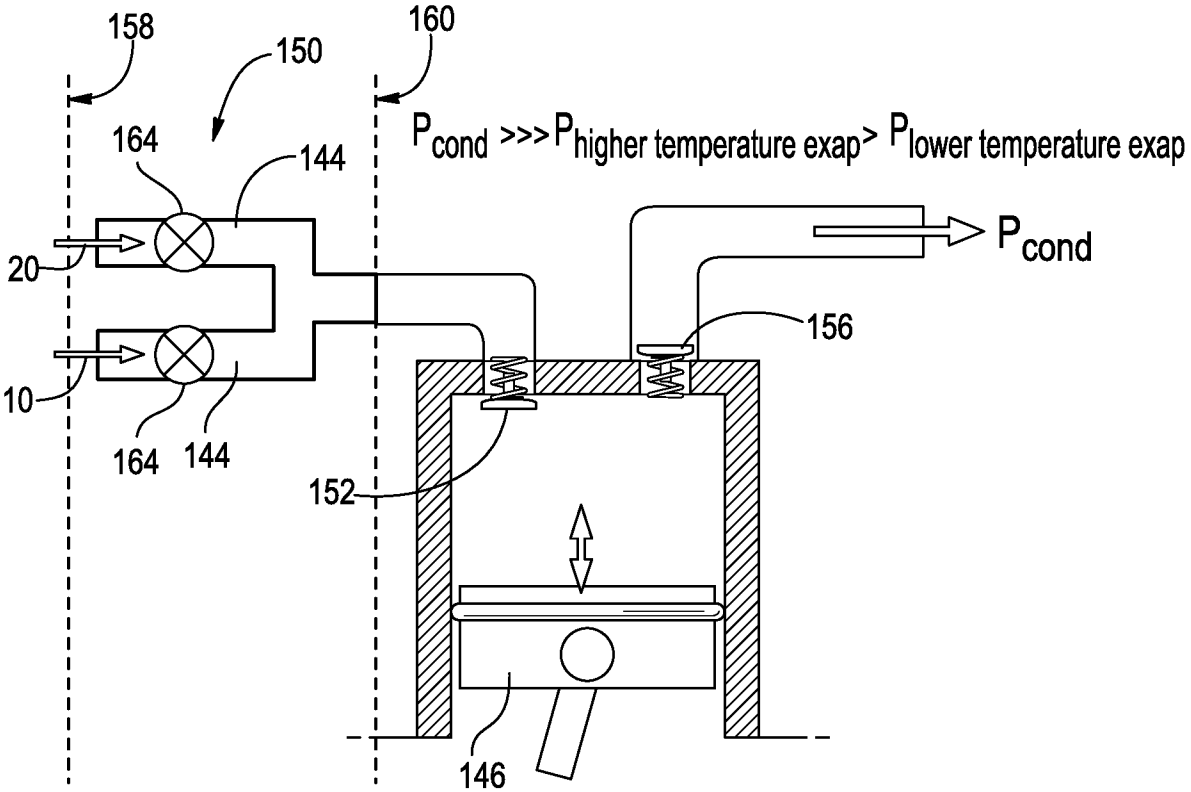
FIG. 13 shows another aspect of a compressor employing two solenoid valves on either inside the compressor or outside the compressor housing (the housing shown by the dashed line) according to an aspect on the present disclosure showing dual suction.

The compressor 116 may be a standard reciprocating or rotary compressor, a variable capacity compressor, including but not limited to a linear compressor, or a multiple intake compressor system (see FIGS. 11-13). When a standard reciprocating or rotary compressor with a single suction port is used the system further includes a switching mechanism 150 containing compressor system (see FIG. 12-13). As shown in FIG. 11, a dual suction compressor 116 according to an aspect of the present disclosure may utilize a valving system 142 incorporated into the compressor that contains two refrigerant fluid intake streams 144, one from the lower temperature evaporator and one from the higher temperature evaporator. When a linear compressor, which can be on oil-less linear compressor, is utilized, the linear compressor has a variable capacity modulation, which is typically larger than a 3 to 1 modulation capacity typical with a variable capacity reciprocating compressor. The modulation low end is limited by lubrication and modulation scheme.

FIGS. 12-13 generally show a switching mechanism 150 according to the present disclosure. FIG. 11, as discussed above, shows a valving system 142 that is used in dual suction port compressor systems. FIGS. 12-13 show a switching mechanism 150 that can be positioned either external or within a single suction port system that allows for two or more fluid intake conduits 144 to feed into the single suction port. A compressor piston 146 is utilized in each dual refrigerant fluid intake systems shown in FIGS. 11-13. In the case of FIG. 11, refrigerant fluid is received into the piston chamber 148 from the lower temperature evaporator and higher temperature evaporator fluid conduits when the piston 146 is drawn backward, the piston chamber intake valves 152 are both opened, or, when the solenoid switch 154 is activated, only refrigerant fluid from the lower temperature evaporator fluid conduit is drawn in, and the piston chamber intake valve 152 associated with the intake from the higher temperature evaporator fluid conduit is not actuated, but retained in a closed position. When the piston stroke is actuated toward the piston chamber valves, piston chamber outlet valve 156 is opened by fluid pressure to allow refrigerant fluid to pass to the condenser 118.

Alternatively, depending on which circuit will be open more frequently, when the higher temperature evaporator circuit is opened less frequently such as will typically be the case in the case of the system of FIG. 3, the valve 152 to the higher temperature evaporator circuit might be biased, typically by a spring, to a normally closed position and the solenoid would bias the valve to the open position when cooling is requested by the system. In this manner still further energy is saved. Additionally, the solenoid valve could be of the latching type that requires only a pulse (typically on the order of 100-1500 milliseconds) of energy to actuate.

An alternative aspect is shown in FIGS. 12-13, which show a single piston chamber intake valve 152, which is fed from a switching mechanism 150. The switching system 150 as shown by lines 158 and 160, which represent the housing of the compressor, may be within the housing of the compressor when the housing is at position 158 relative to the switching mechanism 150 and outside of the housing when the housing is in position 160 relative to the switching mechanism 150. The position of the housing (represented by reference numerals 158 and 160) in FIGS. 12-13 are simply meant to display that the switching mechanism 150 may be outside of the housing or within the housing of the single suction compressor. The switching mechanism 150 may employ a magnetically actuated solenoid system where obstruction 162 is actuated between a first position (shown in FIG. 12) allowing refrigerant to flow from the (higher pressure/temperature) evaporator and a second position (not shown) where the obstruction 162 is positioned to block fluid paths from the higher pressure/temperature evaporator and allow refrigerant to flow from the (lower pressure/temperature) evaporator. The alternative aspect shown in FIG. 13 shows two solenoid valves 164 that may be controlled by the control unit 140 to be in an open or closed position. The solenoid valves 164 alternate refrigerant flows to the compressor between refrigerant from the first fluid conduit and the second fluid conduit. The solenoid valves are typically only opened one at a time. In the aspects of FIGS. 11-13 of the compressor systems, the pressure of the refrigerant fluid leaving the compressor for the condenser is significantly higher than the pressure of the refrigerant received from the higher temperature evaporator or the lower temperature evaporator, but the pressure of the refrigerant received from the higher temperature evaporator fluid conduit is greater than the refrigerant received from the lower temperature evaporator fluid conduit. This, as discussed above, allows for greater efficiencies of the overall refrigerant system. In various aspects, a stepper motor can be used instead of a solenoid valve to provide for multiple paths of refrigerant 62 to the various evaporators 64, 66 of the air conditioning system 110. The stepper motor used in the various aspects can be configured to selectively provide a flow of refrigerant 62 to various individual evaporators 64, 66, subcombinations of various evaporators, or to all of the evaporators of the air conditioning system. Stepper motors used in the various aspects are similar to those manufactured by Saginomiya, Inc. of Tokyo, Japan.

Figure 10B:
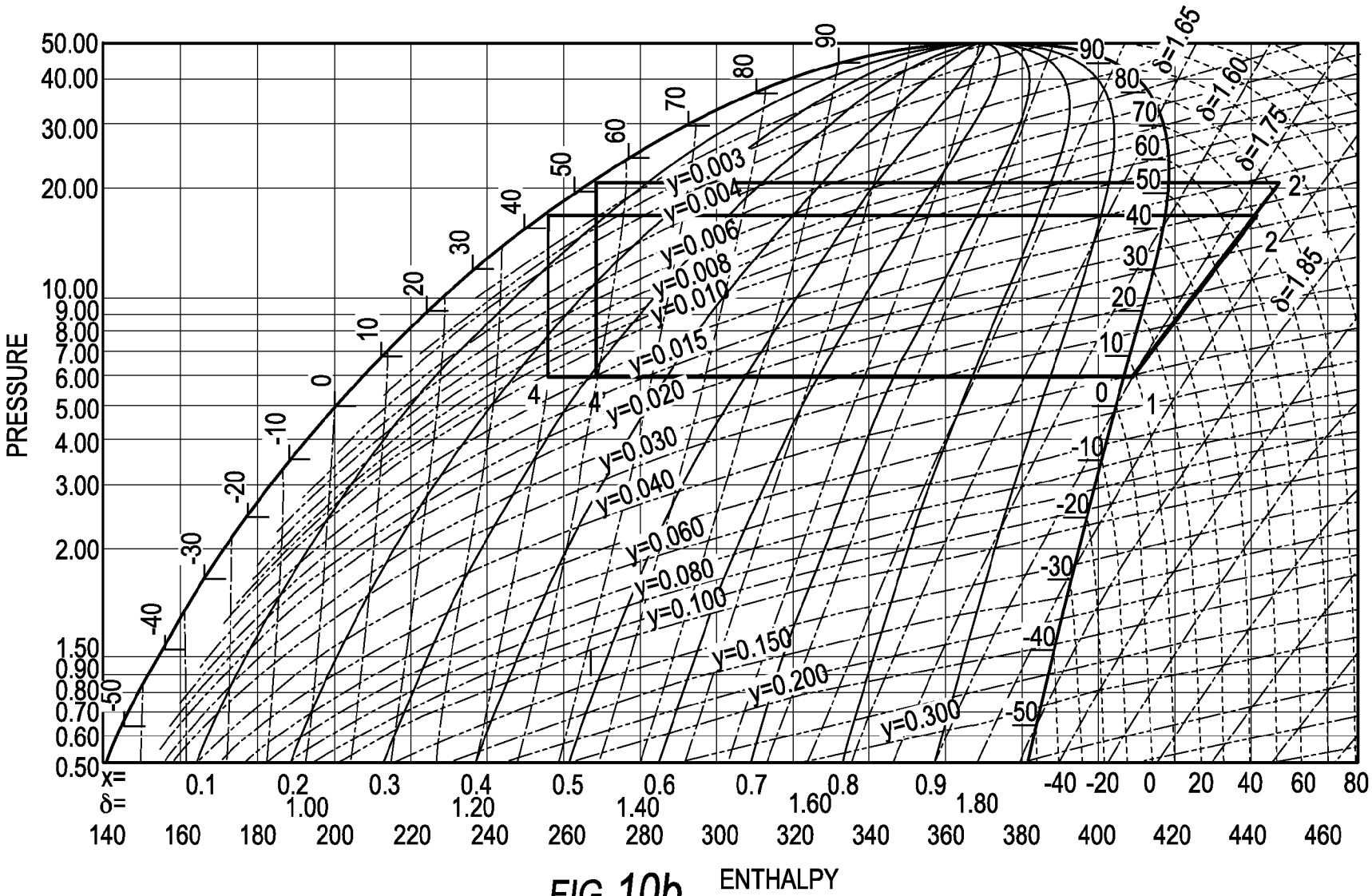
FIG. 10*b* is a thermodynamic cycle of a dual discharge compressor containing air treatment system that may be utilized in connection methods of improving efficiency of the air conditioning system according to an aspect of the present disclosure.
Figure 15:
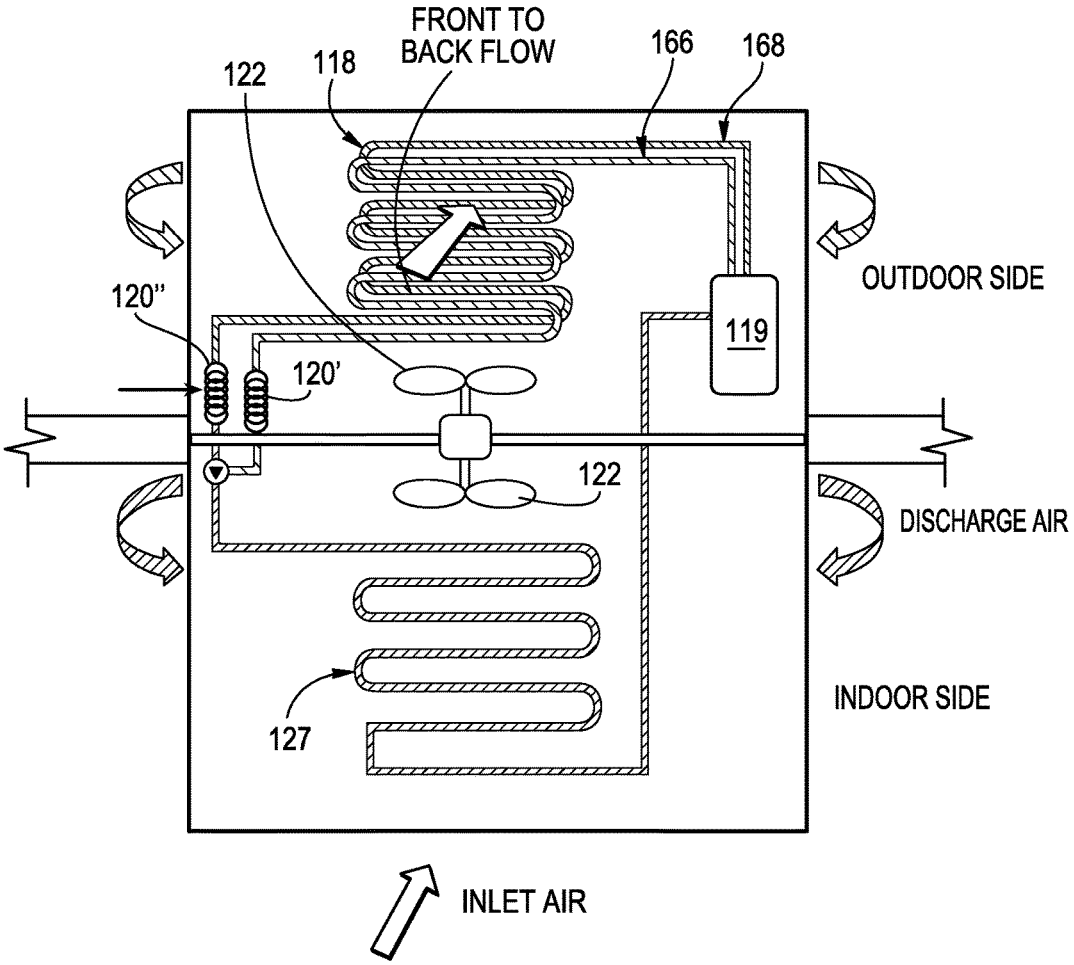
FIG. 15 is a schematic view of a dual discharge compressor containing air conditioning system of the type described in the thermodynamic cycle of FIG. 4*b* according to an aspect of the present disclosure.
Figure 16:
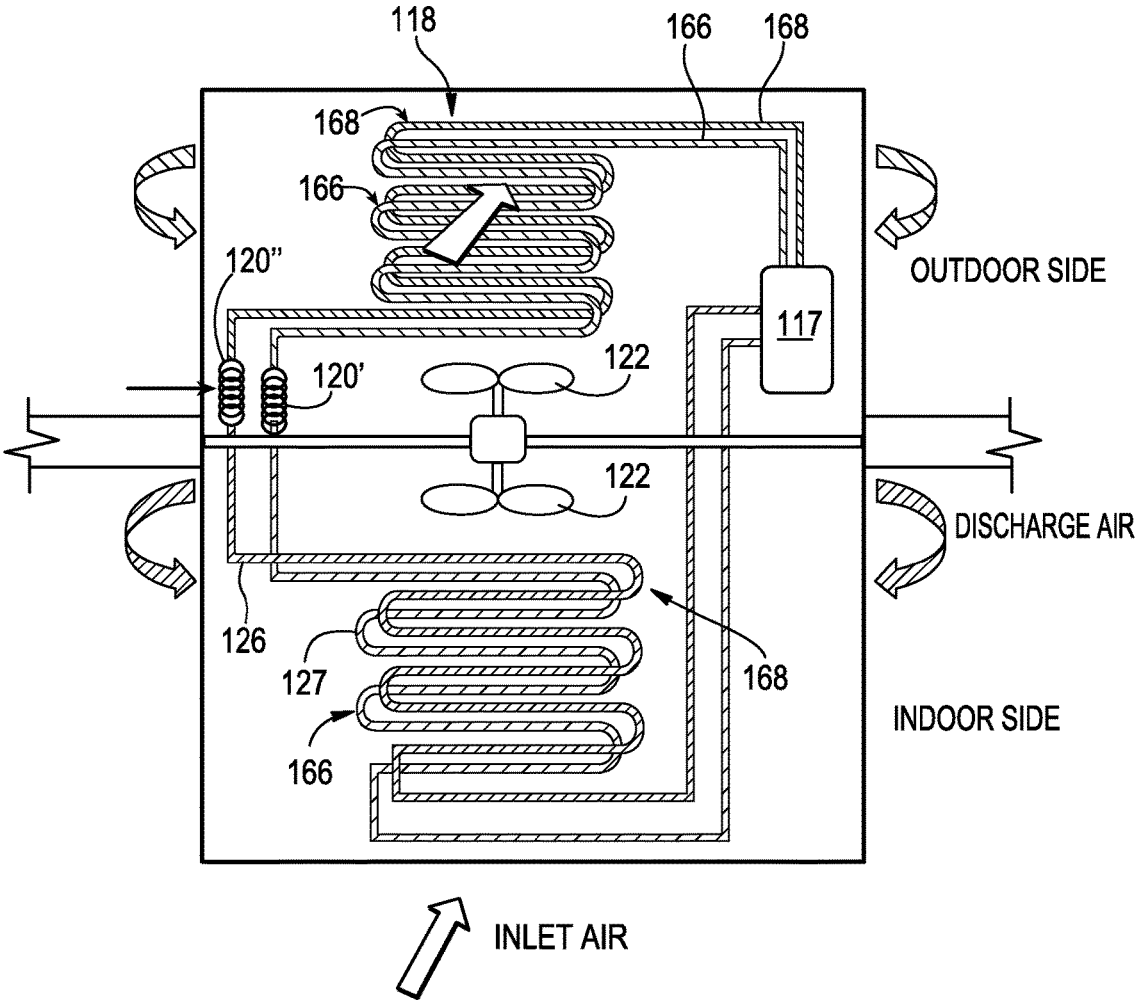
FIG. 16 is a schematic view of a dual suction and dual discharge compressor containing air conditioning system of the type described in the thermodynamic cycle of FIG. 4*a* according to an aspect of the present disclosure.

As shown in FIGS. 15-16, still further efficiencies can be gained on the air conditioning systems by using a multi/dual discharge compressor that is either a single suction (see FIG. 15) or a multi (dual-) suction compressor (see FIG. 16). In the case of dual discharge compressors, the dual discharge refrigerant fluid conduits typically independently feed separate thermal expansion devices 120', 120" after passing through the condenser 118. The refrigerant flows from the first circuit 166 of the condenser to the evaporator 127 via a less restrictive thermal expansion device 120' and from the second circuit 168 of the condenser to the evaporator 127 via a more restrictive thermal expansion device 120" than the thermal expansion device 120'. The dual discharge compressor 117, 119 rapidly switches between the two discharge ports. The frequency of the switching and the duration of operation of each port can be controlled by the control unit 140 to match the heat load requirement of each circuit of the condenser. Since the first circuit operates at a lower condensing temperature, the thermodynamic efficiency of the cooling system is improved as shown in FIG. 10*b*.

Figure 14B:
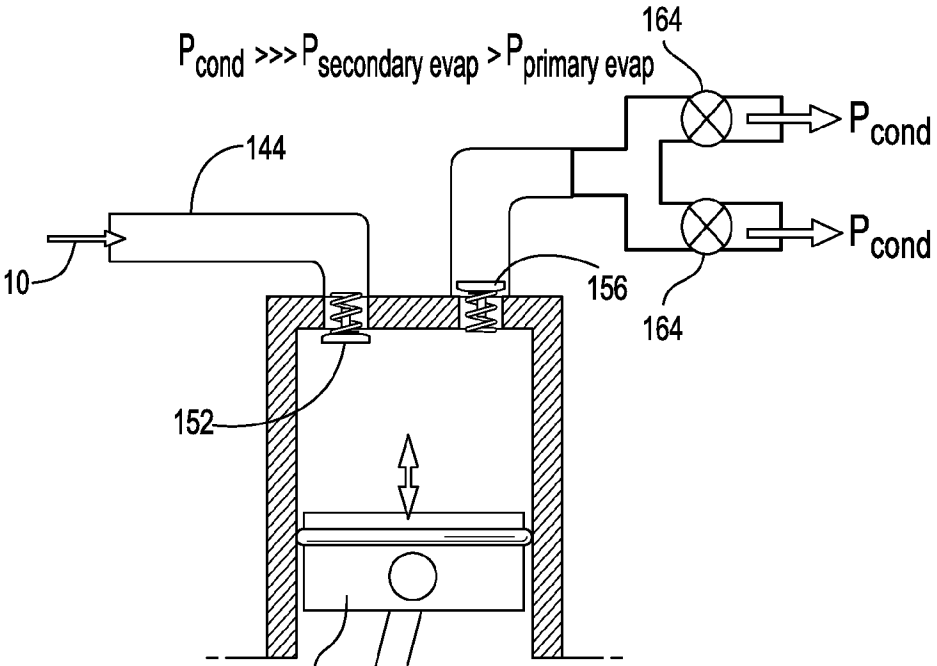
FIG. 14*b* is a schematic view of a single discharge compressor with a dual discharging switching mechanism.
Figure 14A:
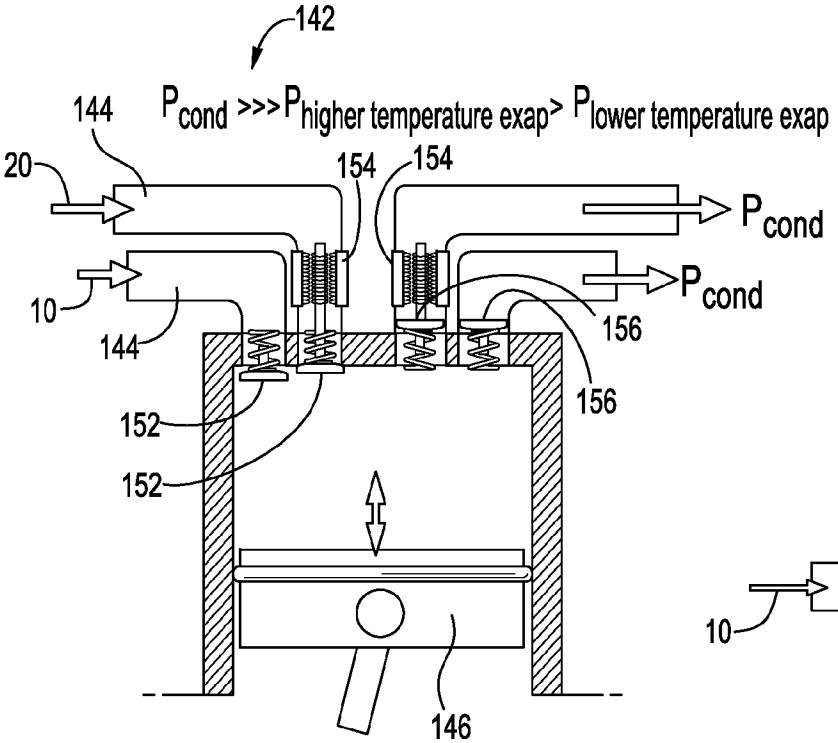
FIG. 14*a* is a schematic view of a dual suction-dual discharge compressor.

Similar systems as used in connection with the suction side of the compressor may also be used in connection with the discharge side of the compressor. The compressor may be a dual suction-dual discharge compressor (FIG. 14*a*). As shown in FIG. 14*a*, the compressor may include two intakes 144 and two outlet valves 156. Alternatively, as shown in FIG. 14*b*, a switching mechanism may be used on the discharge side of the compressor and positioned within or outside the housing of the compressor. The switching mechanism may use a magnetic actuated obstruction or, more typically one or more solenoid valves 164 to regulate the outgoing flow of refrigerant fluid to the compressor coils.

As shown in FIG. 16, the system using a dual discharge compressor may be combined with the use of a dual suction aspect to the compressor to provide the dynamic adjustability to make the system as efficient as possible by taking advantage of the concepts of dual suction efficiency discussed above and the concepts of dual discharge and rapid switching also discussed above. Conceivably, the compressor may have multiple suction ports and multiple discharge ports. More than two of each could be employed to create still further efficiencies and flexibility in humidity adjustment as discussed herein.

The systems with dual discharge may use the staged condenser coils to provide heating to a household appliance. For example, the condensers might be thermally associated with a water heater or a drying chamber.

FIGS. 17*a*, 17*b*, 18*a*, 18*b* show two aspects that show a thermally disjointed evaporator system with the lower temperature and higher temperature evaporators working together to regulate sensible and latent heat but where there is either a thermal break (FIGS. 17*a*, 17*b*) or physical separation (FIGS. 18*a*, 18*b*) between the lower temperature evaporator 127 and the higher temperature evaporator 126.

Figure 17A:
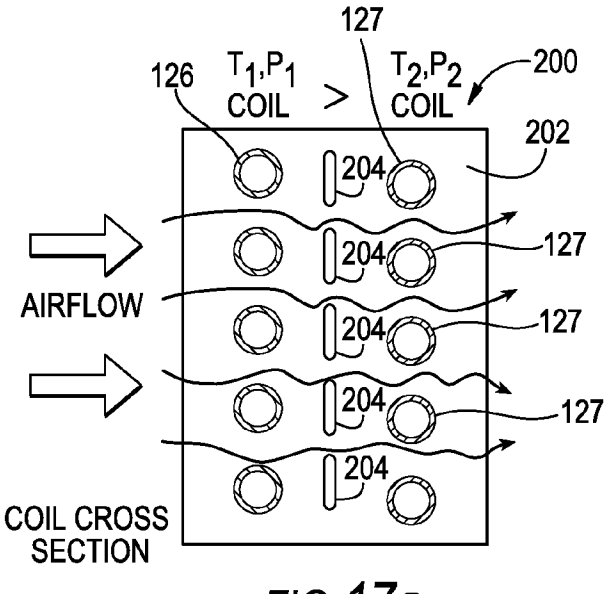
FIG. 17*a* is a side schematic view of an evaporator system according to an aspect of the present disclosure employing evaporator coils operating at different temperatures and interconnected with common fins.
Figure 17B:
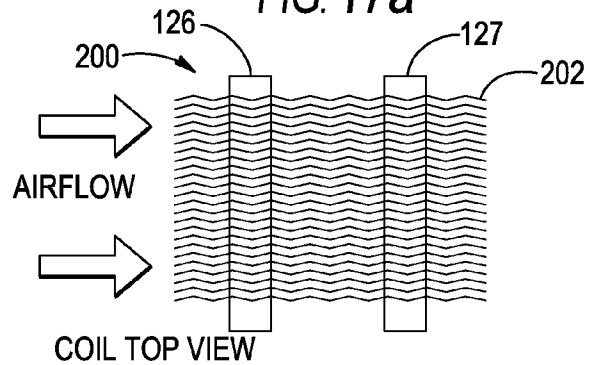
FIG. 17*b* is an elevated schematic side view of the evaporator of FIG. 17*a;*

FIGS. 17*a* and 17*b* show a disjointed evaporator system 200 that employs the lower temperature evaporator 127 and the higher temperature evaporator 126 in a manner that they share common fins 202. The common fins have at least one and more typically a plurality of thermal break portions 204 at a distance from the evaporator tubes to elongate and interrupt the conductive heat flow path. The lower temperature evaporator 127 and higher temperature evaporator 126 have a plurality of conduit loops and are parallel with one another. The evaporator coils generally define a first temperature zone of the evaporator system and a second temperature zone of the evaporator system. The zones are generally separated by the thermal break portions 204 that are positioned generally down the center of the evaporator system between the lower temperature evaporator coil section and the higher temperature evaporator coil section of the evaporator system, which are generally each a half of the overall evaporator system.

Figure 18A:
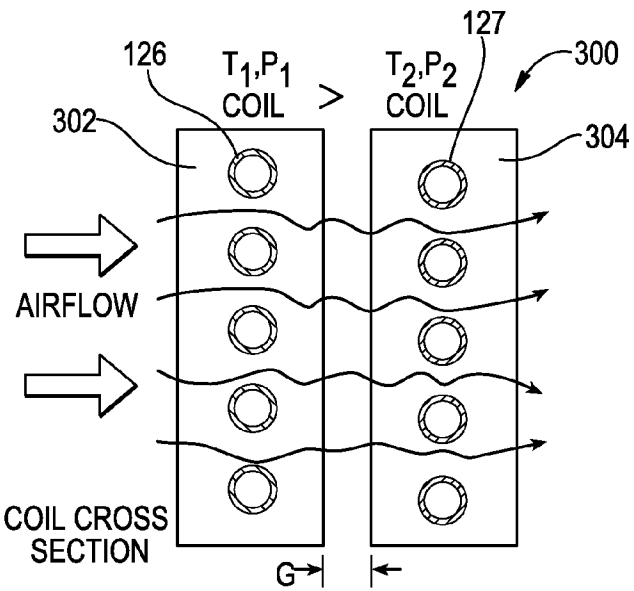
FIG. 18*a* is a side schematic view of an evaporator system according to an aspect of the present disclosure employing evaporator coils operating at different temperatures that are disconnected by having fins of one evaporator constructed and aligned to feed airflow into the fins of the lower temperature evaporator.
Figure 18B:
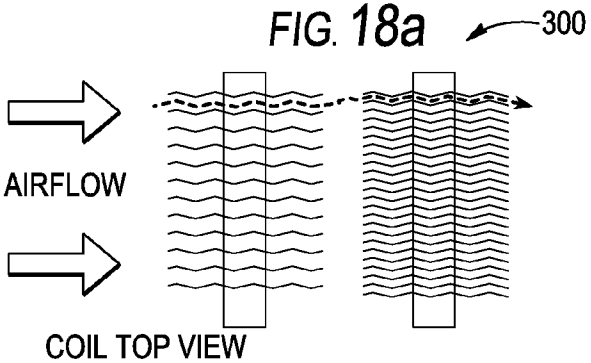
FIG. 18*b* is an elevated schematic side view of the evaporator of FIG. 18*a;*

FIGS. 18*a*, and 18*b* show an alternative disjointed evaporator system that align and position fins 302 and fins 304 relative to one another such that the spacing of the fins that are engaged with the higher temperature evaporator 126 are spaced apart to facilitate the shedding of the condensate off the fins for optimal heat transfer. The spaced apart fins (less than 22 fins per inch, more likely about 14 to about 18 fins per inch) are typically designed to feed the air flow into the space between fins 304 that are operably connected to the lower temperature evaporator, which predominately regulates sensible cooling, but do some dehumidification as well. This construction helps facilitate condensate shedding and the transfer of latent heat and overall heat transfer. The downstream fins 304 have greater fins per inch of evaporator coil than the upstream fins to facilitate heat transfer with the airflow through the fins, for example, the fins might be present in an amount of greater than 22 fins per inch, i.e. 25 fins per inch or more. The lower temperature evaporator 127 and fins 304 would be primarily responsible for mostly sensible cooling and some latent cooling in the system. The higher temperature evaporator 126 and fins 302 would be primarily responsible for most of the latent heat cooling and some sensible cooling. Both evaporators will regulate latent and sensible heat to some degree. These evaporator systems would most typically be employed when the lower temperature and higher temperature evaporators are spaced proximate to one another such as in the aspect of the present disclosure depicted schematically in FIG. 2. Such configurations with greater spaced apart fins could be used in other aspects with the evaporators are not proximate one another. For example, in the context of FIG. 3, the evaporator system could be used and the evaporators would not be arranged relative to one another and the airflow path to have the airflow over the fins 302 feed between the fins 304, but the more compact nature of the fins 304 would enhance the sensible heat energy transfer and the more spaced fins 302 would facilitate the initial latent heat energy transfer and subsequent condensate drainage.

Figure 19:
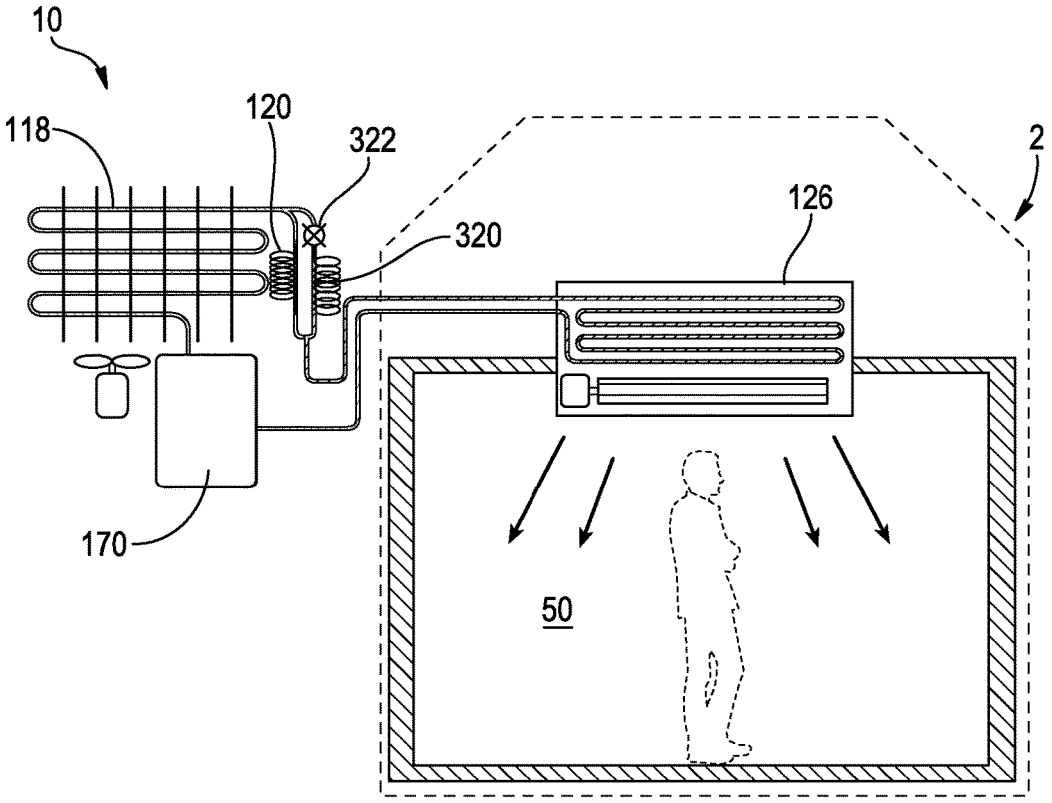
FIG. 19 is a schematic view of an air conditioning system for a building structure according to an aspect of the present disclosure employing a pull-down cooling mode having a parallel expansion device and a two-way solenoid valve.
Figure 20:
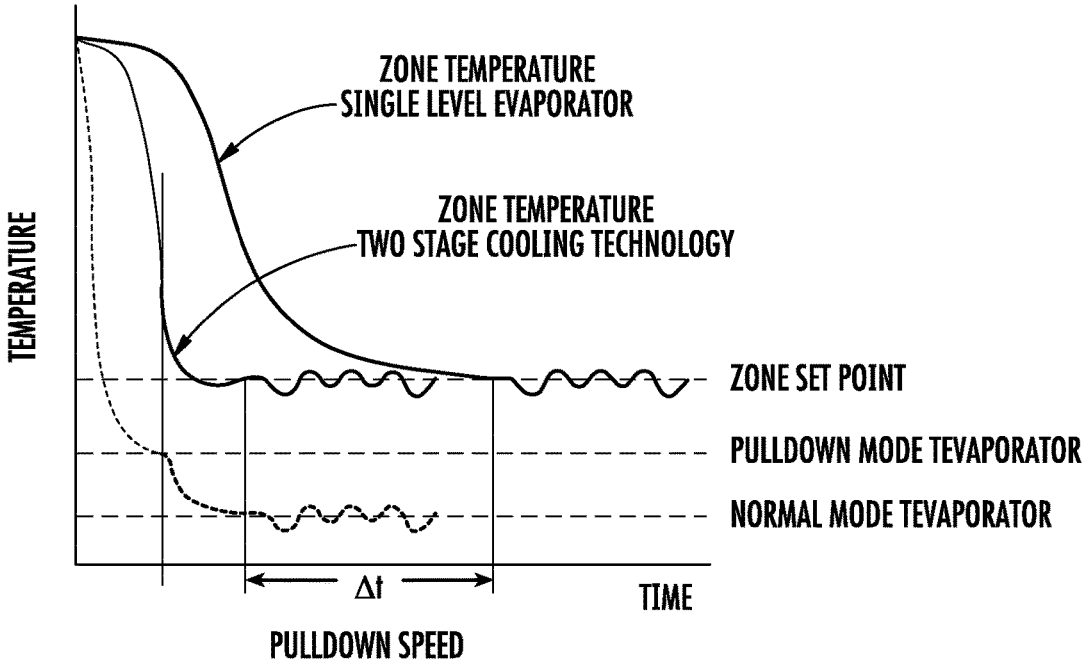
FIG. 20 is a schematic diagram showing the cooling speed of an air conditioning system utilizing a maintenance/normal stage and a pull-down cooling stage.
Figure 21:
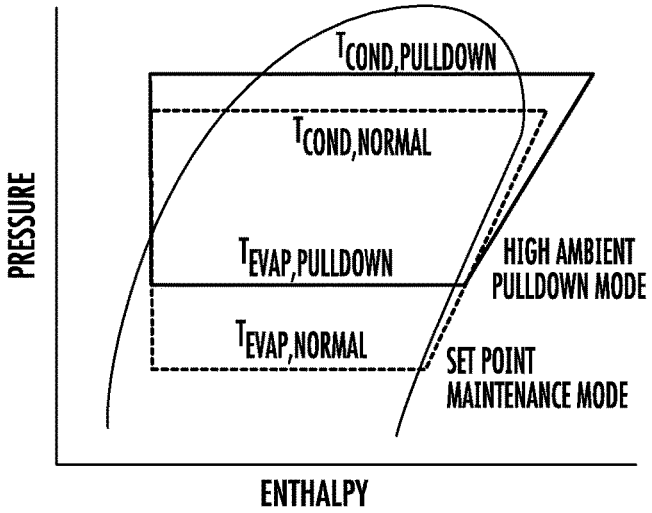
FIG. 21 is a thermodynamic cycle of an air conditioning system utilizing a maintenance/normal stage and a pull-down cooling stage that may be utilized in connection methods of improving efficiency of the air conditioning system according to an aspect of the present disclosure.

As illustrated in FIGS. 19-21, various aspects of the air conditioning system 10 can include a two-stage cooling system to provide an efficient and rapid pull-down cooling stage to a given zone 50. The pull-down cooling stage is initiated when the ambient temperature greatly exceeds the preselected set point of the air conditioning system 10 for that particular zone 50. This typically occurs when the temperature outside the building structure 2 is relatively high and the air conditioning system 10 has remained off for a period of time such that the interior temperature is also significantly elevated. The pull-down cooling stage can also be initiated by a drastic increase in temperature resulting from doors and windows being left open or a significantly greater internal heat load. In these and other situations of elevated heat levels, the pull-down cooling stage provides a supplemental flow of refrigerant 62 to at least one of the evaporator circuits 126 to increase the evaporating temperature such that greater levels of cooling are provided to the zone 50 to decrease the temperature in the space substantially faster than a typical single stage cooling system is capable of doing.

To achieve a two-stage cooling system, a two-stage throttling is provided by adding a second parallel capillary tube 320 and a two-way solenoid valve 322 to the particular evaporator circuit 126 (FIG. 19). Upon initial start, the system runs less restricted through the two parallel capillary tubes 120, 320 and thus at higher evaporator temperatures. This increases the cooling capacity (see FIGS. 20-21). As the zone 50 temperature moves closer to the set point temperatures load, the system throttles down and runs at the lower evaporator temperature (lower capacity) that more closely matches the steady state temperature maintenance load.

When the temperature in the zone 50 reaches a predetermined value, and the air conditioning system 10 is turned on, temperature and humidity sensors communicate with the two-way valve 322 to initiate the pull-down cooling stage. To increase the flow of refrigerant 62, the two-way valve 322 opens the passage way to the second parallel capillary tube 320 to increase the flow of refrigerant 62 to the evaporator circuit 126. The additional refrigerant flow keeps the evaporator coil flooded with liquid refrigerant 62 thereby making the cooling rate faster than if the evaporator coil were getting smaller amounts of refrigerant 62. Once the temperature of the zone 50 being served by the evaporator 126 reaches a predetermined maintenance level, being a temperature substantially near the predetermined set point for that particular zone 50, the two-way solenoid valve 322 closes the passage way to the second parallel capillary tube 320 to decrease the amount of refrigerant 62 provided to the evaporator 126. As a result, the evaporating temperature is decreased such that less cooling is provided to the zone 50. In this manner, the pull-down cooling stage ends and a maintenance stage begins whereby smaller incremental changes in temperature and humidity can be made to maintain the temperature and relative humidity of the space at approximately a predetermined set point for that particular zone 50.

In various aspects of the pull-down cooling stage, higher air flow rates can be used to provide additional throw of air flow throughout the zone 50, such that the additional amounts of cooling provided during the pull-down cooling stage can be spread throughout more of the zone 50 to lower the temperature of the space in a faster, more efficient manner. In this pull-down cooling stage, higher evaporator fan capacity is typically required as the fan needs to be large enough to transfer the extra cooling to the zone 50 from the higher capacity refrigerant flow supplied during the pull-down cooling stage. Additionally, because of the addition of the second parallel capillary tube 320 and two-way solenoid valve 322 to the air conditioning system to provide the pull-down cooling stage, a smaller, less powerful compressor can be used to provide bursts of additional cooling through the second parallel capillary tube 320 that would ordinarily require a larger compressor to provide higher levels of cooling necessary to quickly pull-down the temperature of the zone 50.

As illustrated in the enthalpy/pressure graph of FIG. 21, the air conditioning system, during a pull-down cooling stage, can run at a higher evaporator temperature to provide additional cooling capacity to decrease the temperature in the zone 50 at a faster rate and more efficiently. The evaporator temperature during the normal or maintenance mode is less. However, during the maintenance mode, significantly smaller temperature and humidity modifications are required to maintain the comfort level of the zone 50 within the predetermined parameters. Consequently, a lower evaporator temperature is more efficient during the maintenance mode.

Figure 22:
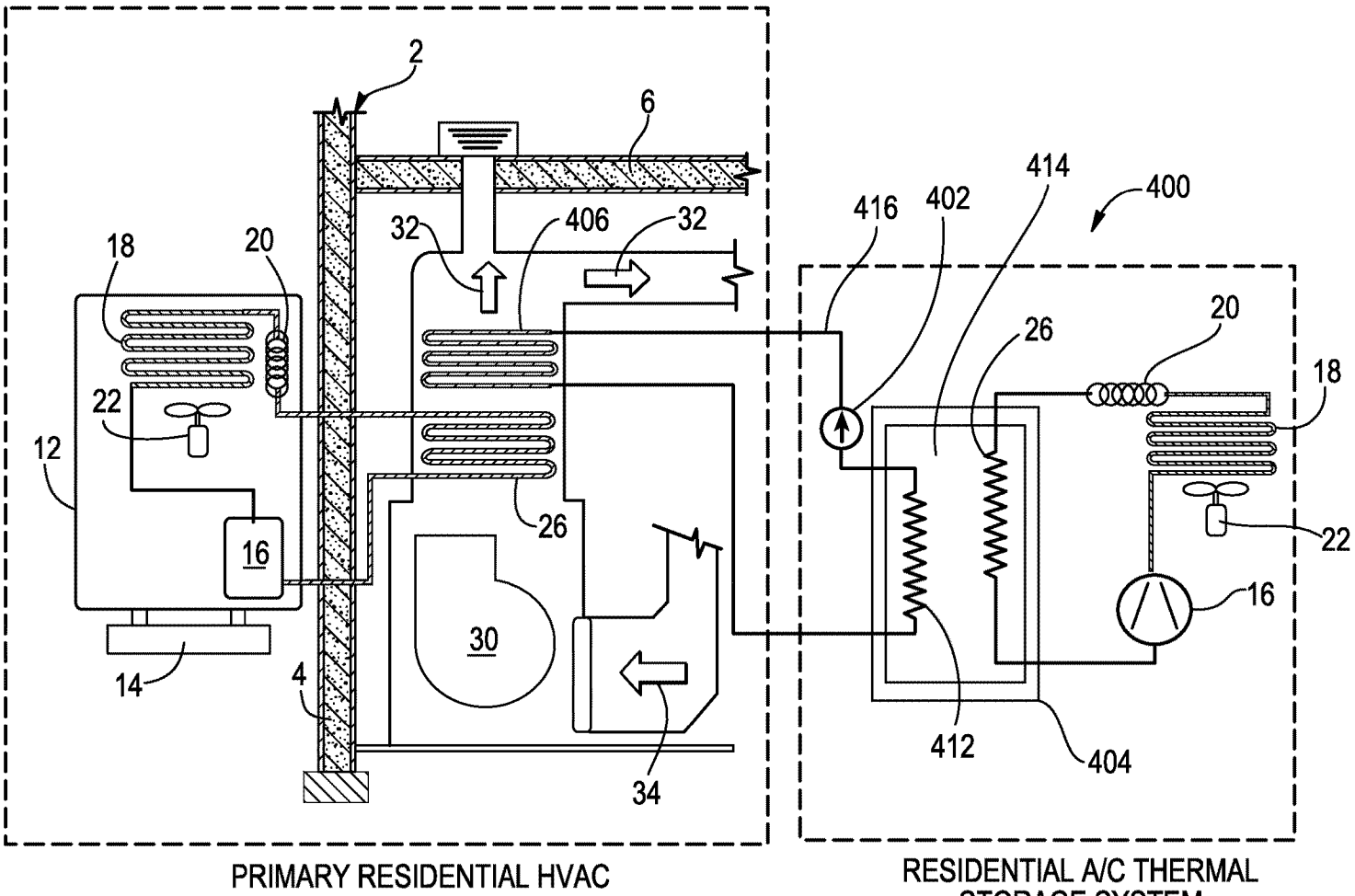
FIG. 22 is a schematic view of another aspect of the present disclosure showing a retrofitted air conditioning thermal storage system.
Figure 23:
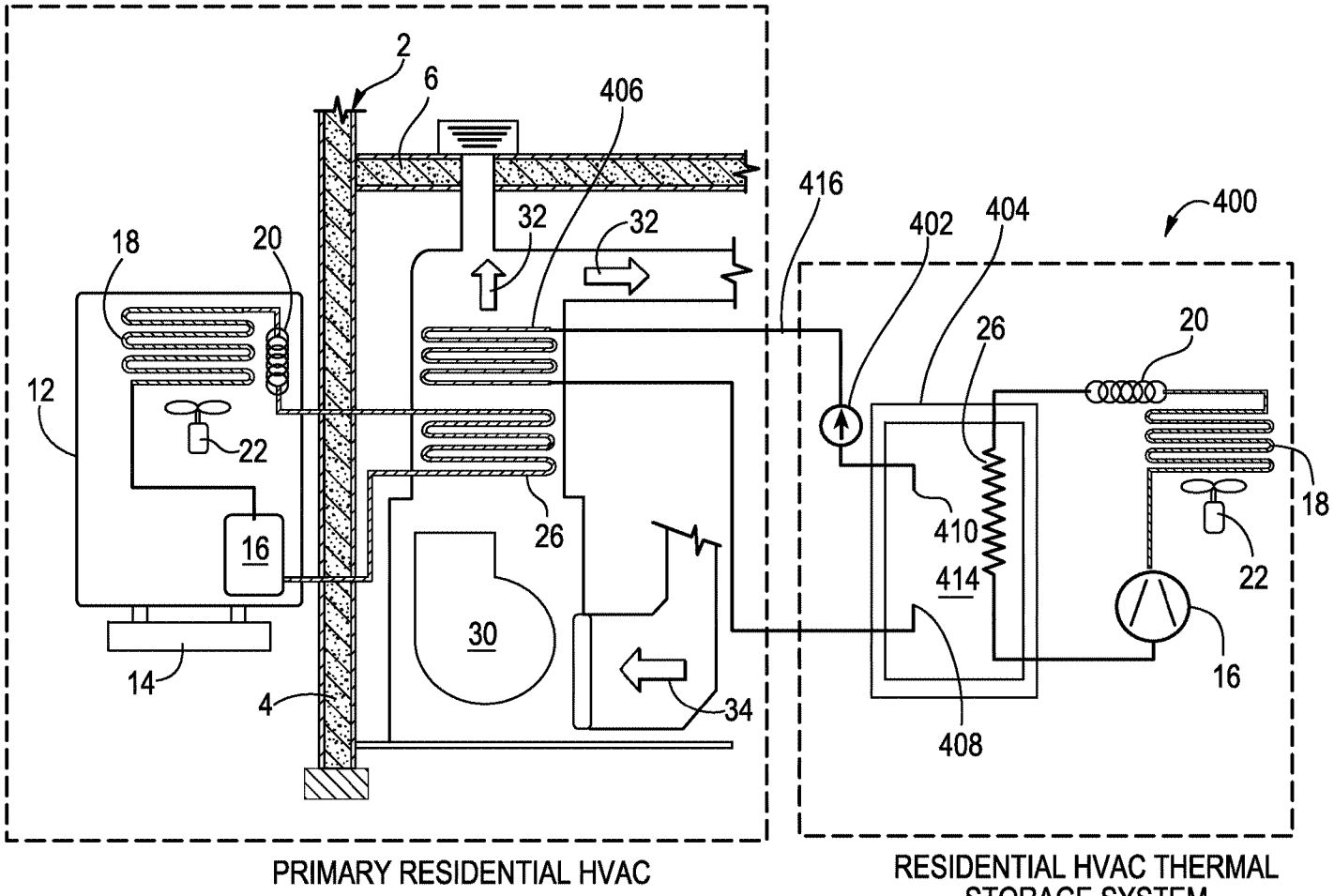
FIG. 23 is a schematic view of another aspect of the present disclosure showing a retrofitted air conditioning thermal storage system.

FIGS. 22-23 show a retrofittable air conditioning system thermal storage system 400. The retrofittable thermal storage system by be employed with the air conditioning systems of the present disclosure or traditional air conditioning systems. FIGS. 22-23 show the retrofittable thermal storage system 400 installed in connection with a traditional air conditioning system such as that shown in FIG. 1.

The retrofittable thermal storage system 400 is installed to store thermal cooling capacity in an air conditioning system for use during peak usage times when the building structure's main cooling system is offline or its use curtailed or otherwise minimized. A pump 402, which may be positioned before or after the thermal energy storage fluid tank 404 along the refrigerant loop 416. While shown schematically as pumping refrigerant fluid in a counterclockwise direction, the directional flow from the pump 402 could be in either direction so long as refrigerant is in thermal communication/contact the thermal energy storage fluid tank 404 and into the airflow path to be cooled by the heat exchanger 406. In the aspect of the disclosure shown in FIG. 22, a heat exchanger 412 is positioned in the thermal energy storage fluid tank 404 and operably connected to the refrigerant fluid lines of the refrigerant loop 416. The thermal energy storage fluid tank 404 is cooled, typically during off peak times, by a refrigeration system employing a traditional compressor 16, condenser 18, thermal expansion device 20, fan 22, and evaporator 26. The evaporator 26 of the retrofittable thermal storage system 400 is spaced within or otherwise in thermal communication with the thermal energy storage material (fluid) 414 within the thermal energy thermal storage fluid tank 404. In the aspect show in FIG. 23, the heat exchanger 412 is omitted and the thermal energy storage fluid within the thermal energy thermal storage fluid tank 404 itself operates at the heat exchanger/refrigerant fluid. Refrigerant fluid in this instance is the thermal energy storage fluid and is received into the tank through outlet 408 and returns to the refrigerant loop 416 through inlet 410.

As shown in FIG. 24, in another aspect of the present disclosure, a split air conditioning system 500 may be utilized to drive a plurality of indoor air units 502. (FIG. 24 shows two indoor air units but multiple indoor air units can be employed and one or more air units may be positioned in various rooms within a building structure.) Each individual indoor air unit 502 can be turned on or off in a given space. The split indoor air conditioning system 500, as shown in FIG. 24, utilizes the dual suction (multi-suction) compressor concepts described herein to provide greater benefits. Switching the suction valves to feed the evaporators of the various air conditioning units in the interior of the home equally or to provide warmer or cooler evaporator temperatures for the respective rooms is possible using this system. The warmer temperature evaporator would cool the air less but still provide a level of dehumidification. The cooler evaporator could be utilized to chill air more but also dry the air more. The cooling capacity and, thus, the temperature of an evaporator at which it functions is based upon the expansion device but also the flow rate of refrigerant and the suction pressure the evaporator sees from the compressor. If the indoor units are identical with identical expansion device resistance, then the multi-suction valve systems of the present disclosure can drive either evaporator to a lower or higher pressure relative to the other evaporator(s). Certain ways to accomplish this include: managing the opening and closing of the compressor suction valve(s) or adjusting the timing of valve opening and compressor piston or vane stroke position to achieve the desired pressure level range. In the example shown in FIG. 24, the upper section might be a living room which is kept cool and dry and driven by a lower temperature evaporator (50° F.). This will provide more cooling capacity (refrigerant flow at lower evaporator pressure) by biasing the duty cycle of the suction port accordingly. The cycle on/off for use of a variable capacity compressor and fan may be utilized to slow the rate of cooling and achieve a slight rise in temperature (55° F.).

As illustrated in FIGS. 26-32, the split air conditioning system 500 can also include a heating element 540 for providing warmed air to a particular zone 54, 56 served by the split air conditioning system 500. In this manner, additional heating appliances such as a central furnace, a radiant heat system, or other separate heating is unnecessary for heating a particular zone served by the split air conditioning system 500. In various alternate aspects, heating can be provided to the zones 54, 56 served by the split air conditioning system 500 by reversing the flow of the refrigerant 62 through the system such that refrigerant 62 travels from the compressor 116 to the respective evaporator 64, 66 then to the condenser 520 and back to the compressor 116. In this manner, the evaporator 64, 66 draws cooling from the ambient air around the evaporator 64, 66 thereby giving off heat, as opposed to cooling, into the space served by the split air conditioning system 500.

As illustrated in FIGS. 28-31, heating provided by separate split air conditioning system 500 can be provided by a heating element 540 disposed within each of the split air conditioning units 502. Each of the split air conditioning units 502 can move air within the space through the use of a scroll fan 550 that rotates to draw in air through one portion of the split air conditioning unit 502 across evaporator coils to cool the air or a heating element 540 to heat the air, and forcing air back out into the respective zone 54, 56 to be conditioned by the split air conditioning system 500. Other types of fans can also be used to move air through the split air conditioning units.

Figure 26:
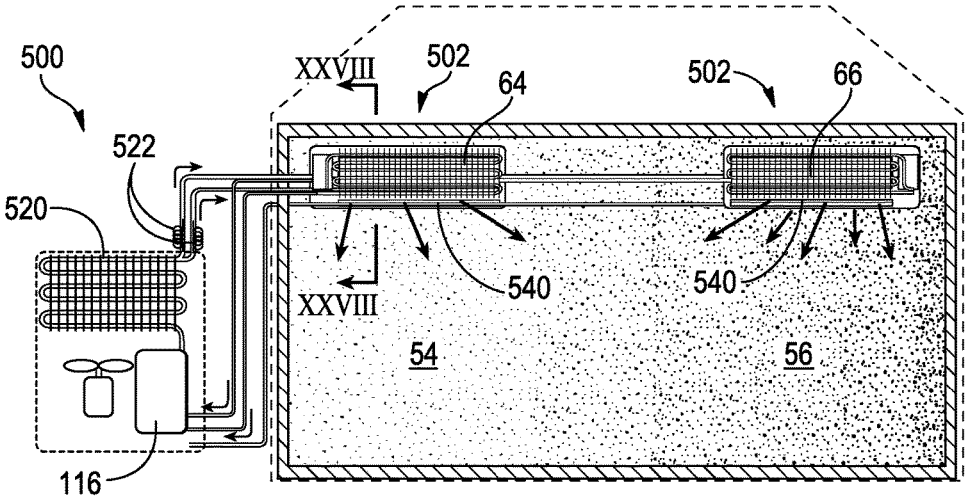
FIG. 26 is a schematic view of a wall-mounted dual split air conditioning system according to another aspect of the present disclosure for serving two zones within a single room.
Figure 27:
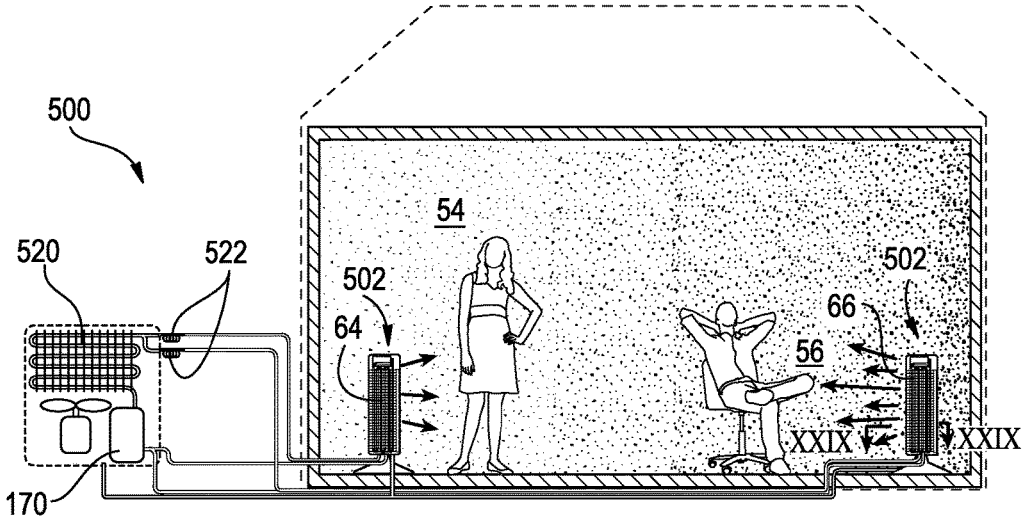
FIG. 27 is a schematic view of a floor-mounted dual split air conditioning system according to another aspect of the present disclosure for serving two zones within a single room.
Figure 27A:
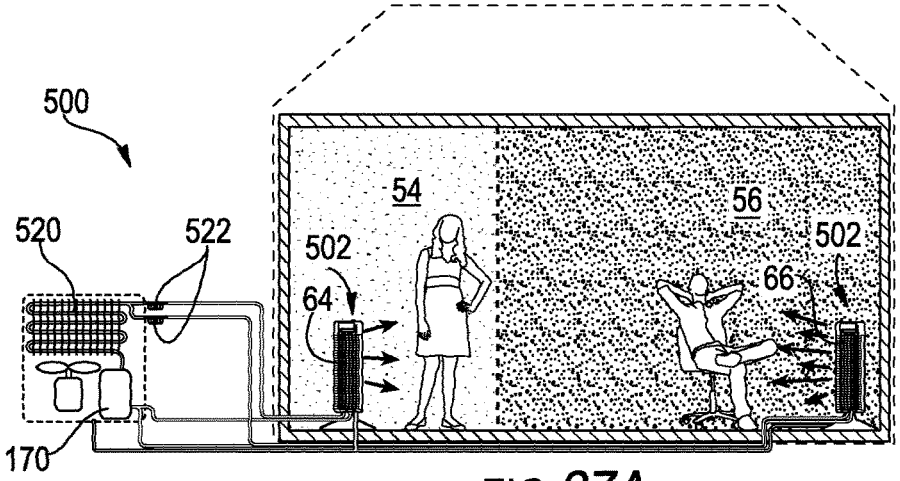
FIG. 27A is a schematic view of a floor-mounted dual split air conditioning system according to an aspect of the present disclosure where the indoor unit on the right has a fan moving a higher volume of air than the indoor unit on the left thereby forming a larger volume of air conditioned air on the right side of the room.
Figure 27B:
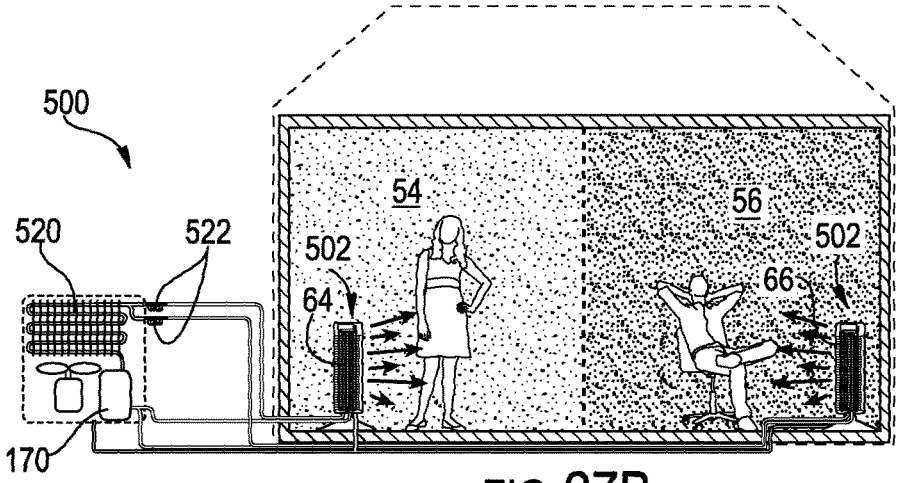
FIG. 27B is a schematic view of a floor-mounted dual split air conditioning system according to an aspect of the present disclosure where the indoor unit on the right has a fan moving a equal volume of air than the indoor unit on the left thereby forming substantially equivalent air conditioned zones on the left and right of the room.
Figure 27C:
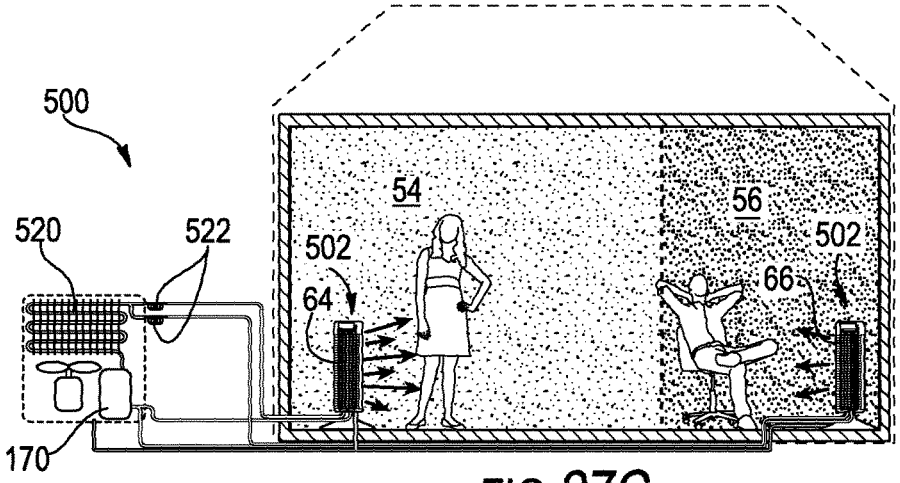
FIG. 27C is a schematic view of a floor-mounted dual split air conditioning system according to an aspect of the present disclosure where the indoor unit on the left has a fan moving a higher volume of air than the indoor unit on the right thereby forming a larger volume of air conditioned air on the left side of the room.
Figure 28:
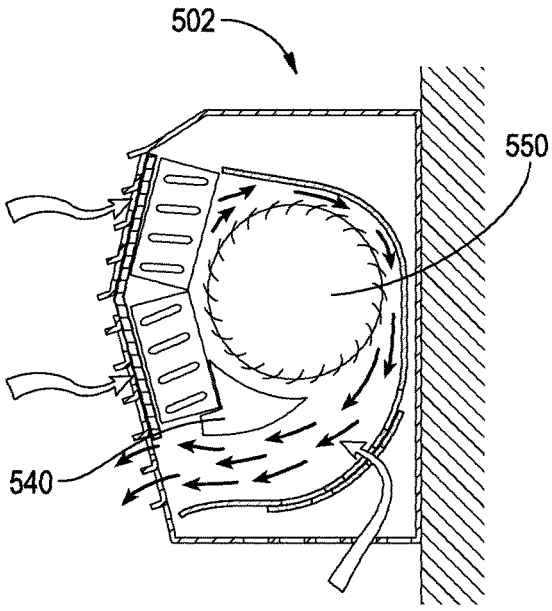
FIG. 28 is a cross-sectional view of a wall mounted split air conditioning unit taken along line XXVIII-XXVIII.
Figure 29:
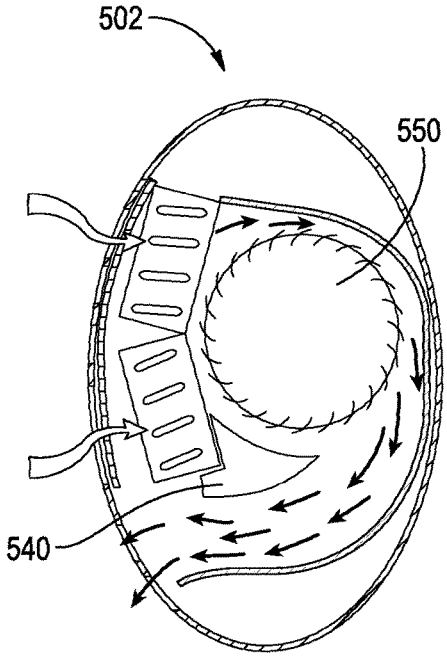
FIG. 29 is a cross-sectional view of a floor mounted split air conditioning unit taken along line XXIX-XXIX.
Figure 30:
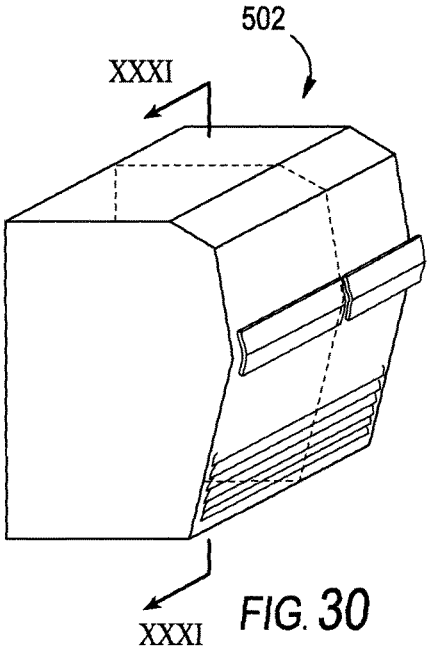
FIG. 30 is a perspective view of a wall mounted split air conditioning system according to another aspect of the present disclosure.
Figure 31:
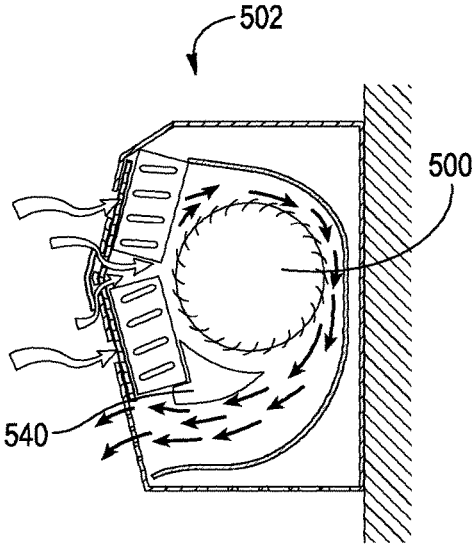
FIG. 31 is a cross-sectional view of a wall mounted split air conditioning unit taken along line XXXI-XXXI.
Figure 32:
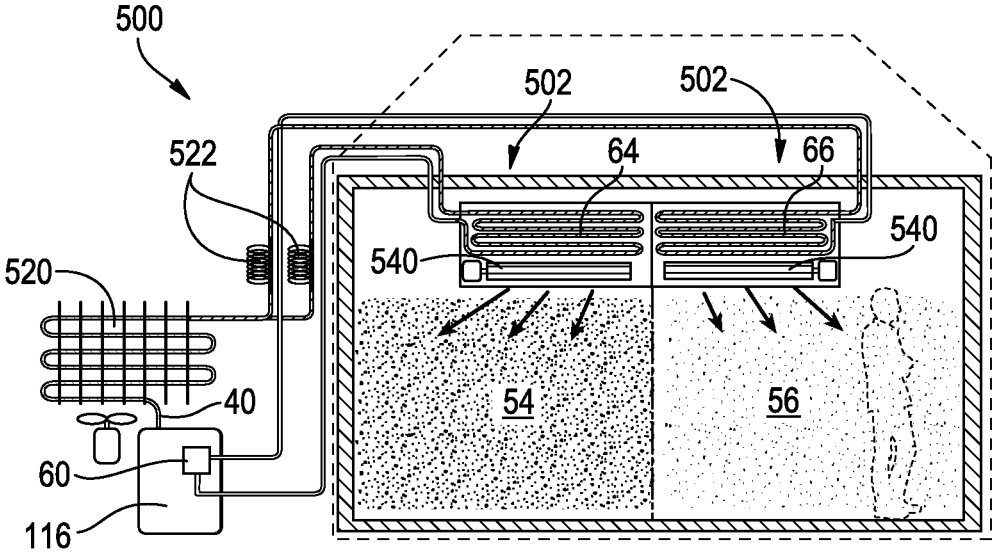
FIG. 32 is a schematic view of a wall mounted single split air conditioning system according to another aspect of the present disclosure for serving two zones within a single room with two evaporator systems within the same housing.

As illustrated in FIGS. 26-27, a single room or other continuous space can be served by multiple individual split system units 502 to provide heating or cooling to multiple zones 54, 56 contained in a single space. These individual split system units 502 can be disposed as floor units, wall units or disposed proximate the ceiling of the space. These individual split system units 502 can provide both cooling and heating such that no additional air handling or temperature controlling system is necessary to serve the respective zones 54, 56 provided by the split air conditioning system 500. The floor units are more typically utilized because they are at the occupant level (typically about six feet high or less) and would not intermix with warmer air typically located at the top of the room. The split indoor units employing at least one evaporator and a fan are also capable of creating and typically configured to create differently sized zones (see FIGS. 27A-C) around each unit depending primarily on the relative fan speed of each indoor split air conditioning unit. Additionally, the cooling capacity of the evaporator(s) of each split air conditioning unit may be independently adjustable according to an aspect of the present disclosure. As such, cooling capacity may be lowered and a high fan speed maintained relative to other split air conditioning unit to maintain a relatively large air treatment zone, but with less cooling. Cooling capacity may be increased (or stay the same and the fan speed lowered) and the air surrounding the unit would be chilled to a greater extent (lower temperature).

The lower section of FIG. 24 might be a bedroom that is kept more cool and moist for optimum comfort (a higher temperature evaporator of about 60° F., for example). This system would provide higher suction pressure and less cooling capacity by biasing the duty cycle of the suction port accordingly.

Figure 25:
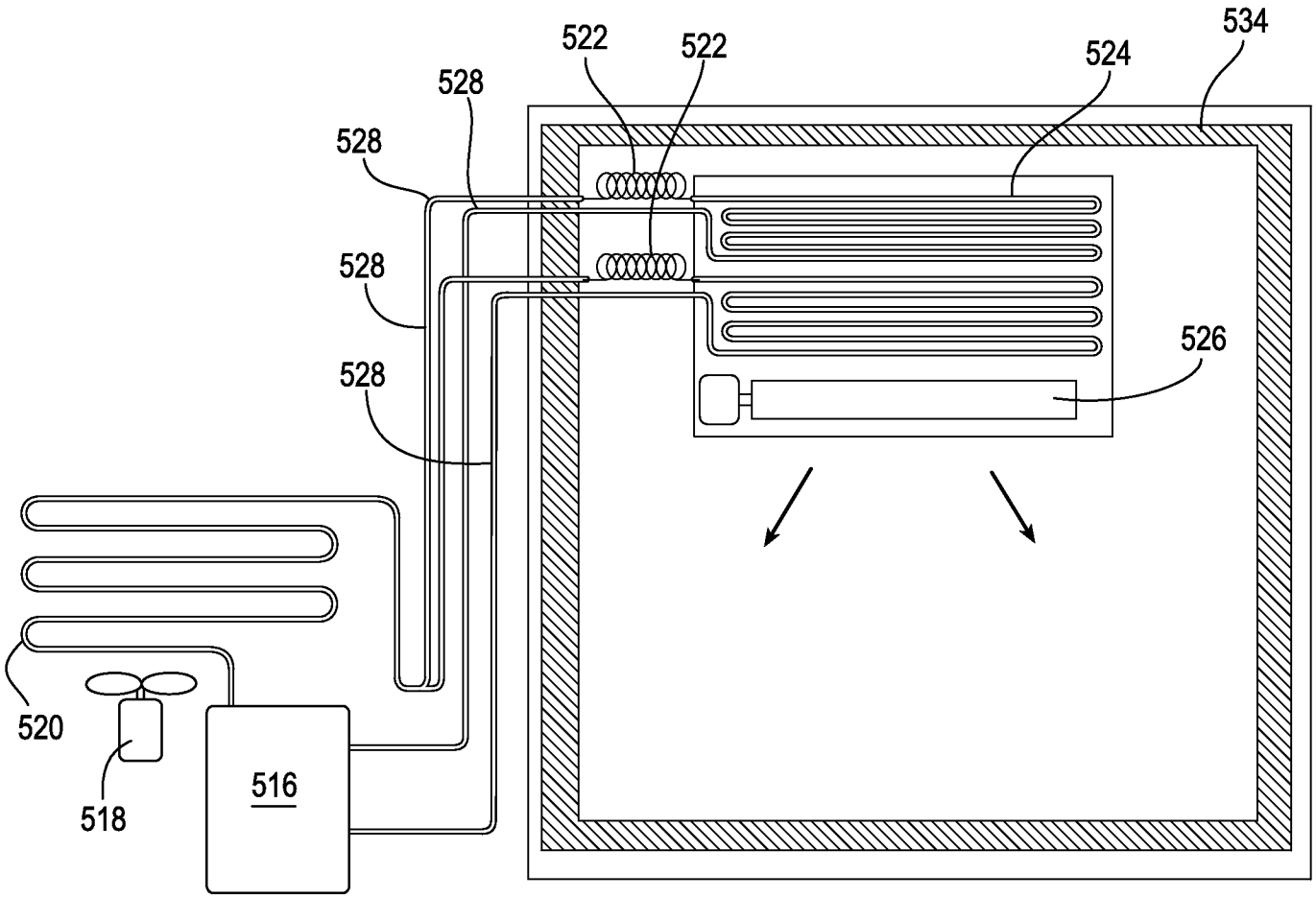
FIG. 25 is another schematic view of a single outdoor air conditioning system according to another aspect of the present disclosure.

The system shown in FIG. 25 shows a single outdoor unit driving a single (potentially multiple) indoor unit(s) in a split system air conditioner with dual (multi) suction and a two-section coil evaporator where the suction lines are free of check valves between the evaporators. Switching the suction valving in this aspect provides more or less chilled air temperatures and more or less humidity in a given conditioned living space. The warmer temperature evaporator would cool the air less but still provide a level of dehumidification. A cooler evaporator would chill the air more but dry the air more. In combination, the air can be cooled and dehumidified to the desired level at an increased effective COP. The cooling capacity and the temperature an evaporator runs at is a function of the expansion device restriction, but also the flow rate of the refrigerant and the suction pressure of the evaporator as discussed above. It is this dynamic in the multi-suction systems of the present disclosure that enables the functionality described above.

Figure 33:
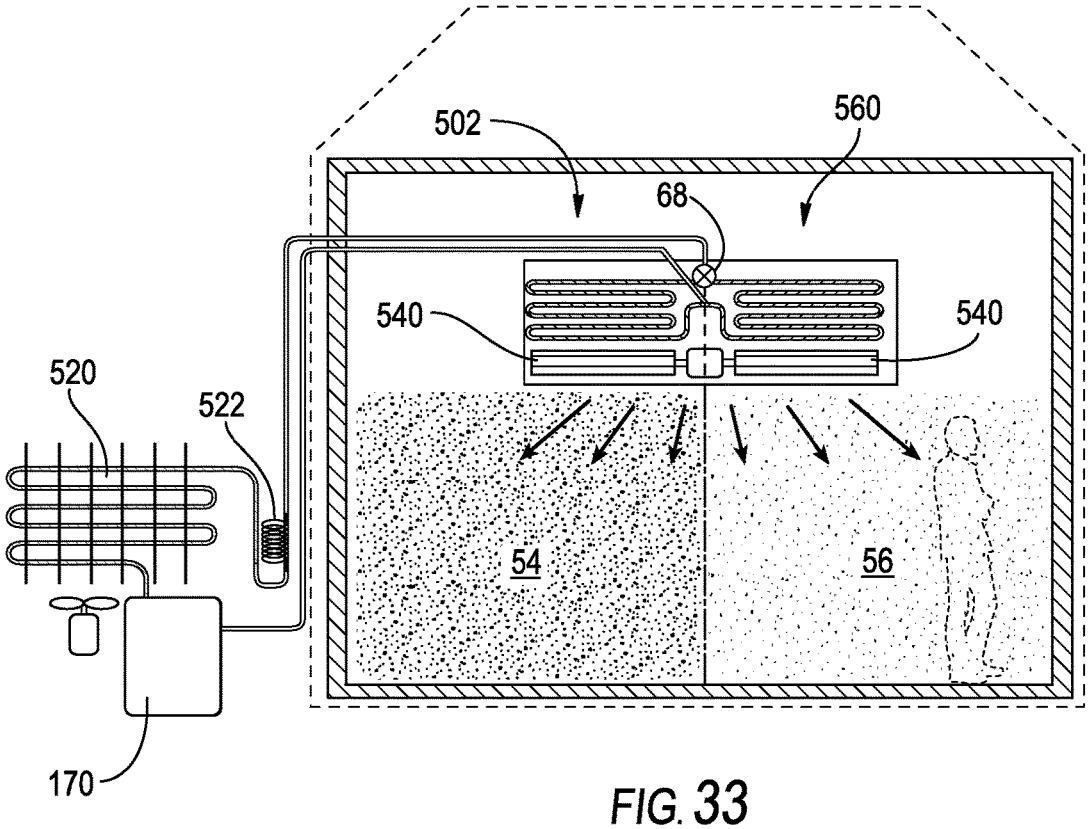
FIG. 33 is a schematic view of a wall mounted single split air conditioning system according to another aspect of the present disclosure for serving two zones within a single room.
Figure 34:
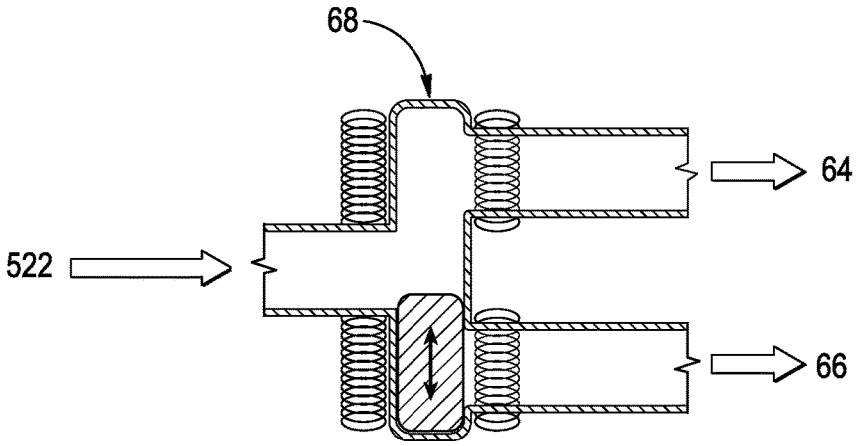
FIG. 34 is a schematic view of a proportional refrigerant flow splitting valve according to the aspect illustrated in FIG. 33.
Figure 35:
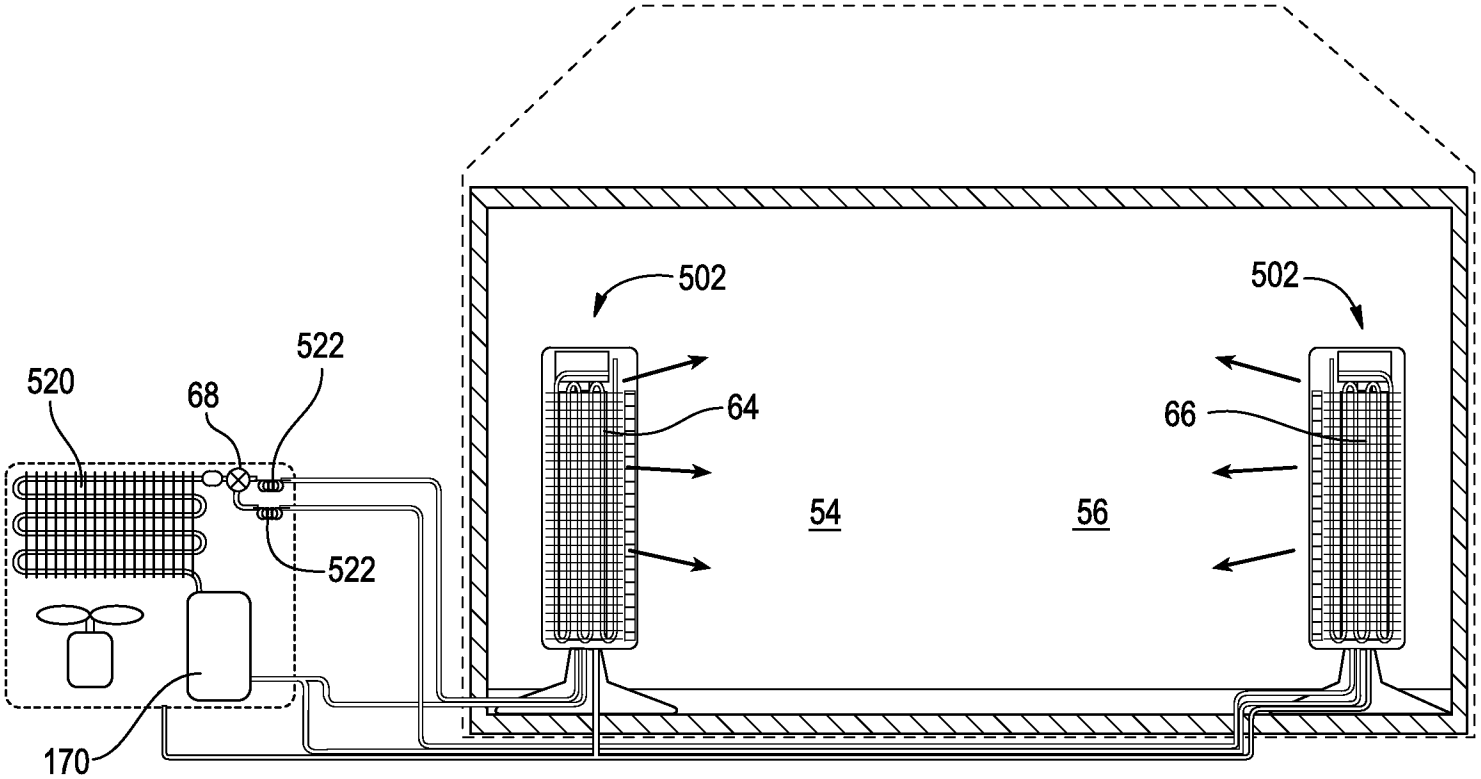
FIG. 35 is a schematic view of a floor mounted single split-unit air conditioning system according to another aspect of the present disclosure for serving two zones within a single room.

As illustrated in FIGS. 33-35, a dual zone indoor air treatment unit 502 can be configured to serve two or more zones 54, 56 within a single room. In this aspect, a single outdoor compressor/condenser unit drives two evaporators 540 configured in a parallel arrangement 560. The flow of refrigerant 62 to each of the parallel evaporators 560 is independently controlled by a proportional flow-splitting valve 68 that provides a quasi-continuous flow of refrigerant 62 from the expansion device 522 and simultaneously through the first and second evaporator circuits 64, 66 and the parallel evaporators 560. In this aspect, the valve is disposed within the indoor unit and proportionately regulates the flow of fluid refrigerant 62 between the parallel evaporators 560. The valve can be a solenoid valve disposed in the liquid refrigerant portion of the system that is configured to rapidly switch between various dedicated parts that provide liquid refrigerant flow to the multiple evaporator circuits. Alternately, the valve can be a stepper motor driven needle that proportionately exposes the various distribution outlet ports to the respective evaporators. The stepper motor can expose, cover or partially cover the various distribution outlet ports through the use of plungers or cam positioning.

As discussed above, the rapidly switching valve 68, or stepper motor valve, allows for the use of a single suction compressor 170, where the refrigerant 62 is delivered proportionately to the various evaporator circuits based upon the cooling load needed among the various evaporator circuits. This configuration allows for the use of a smaller compressor than would typically be needed to serve multiple evaporator circuits simultaneously. In this aspect, a single fan controls the throw of air flow from the parallel evaporators 560 into the zones 54, 56 of the room 52 to provide the proper amount of cooling to regulate the temperature and relative humidity within multiple zones 54, 56 contained in a single room 52. In this manner the refrigerant 62 flow into the parallel evaporators 560 controls the level of heating, as the air flow across each of the parallel evaporators 560 would be the same. In alternate aspects, the parallel evaporators 560 can be disposed within separate split system units 502 such that separate fans can be used to regulate both volumes of air flow as well as the flow of refrigerant 62 into each of the split system units 502.

FIG. 24 shows the compressor, which is typically a multi-suction compressor 516, a fan 518, a condenser 520, expansion devices 522, evaporators 524, and cross-flow fans 526 all fluidly connected by refrigerant fluid conduits 528. The evaporators 524 are each individually spaced in separate building structure cooling zones or rooms, 530 and 532 in FIG. 24. FIG. 25 shows a similar system, but the two evaporators, as discussed above, are in the same unit and used to condition the space within a single zone or room of a structure 534.

The aspects described herein are configured to provide cost savings and energy savings over conventional air conditioning systems.

Those skilled in the art will recognize, or be able to ascertain using no more than routine experimentation, many equivalents to the specific aspects of the disclosure described herein. Such equivalents are intended to be encompassed by the following claims.

The disclosure claimed is:

1. A split air conditioning system for conditioning a plurality of zones within a single living area of a building, the split air conditioning system comprising:

a single outdoor unit comprising:

a compressor; a condenser; and a condenser fan associated with the condenser that moves air to cool the condenser;

a refrigerant flow pathway comprised of a plurality of refrigerant conduits having a common refrigerant flow path, portion and at least two divergent flow path portions, a first divergent flow path portion that delivers refrigerant to a first evaporator configured to operate at a first evaporator pressure and a second divergent flow path portion that delivers refrigerant to a second evaporator such that the first evaporator and second evaporator are in parallel with one another;

at least one throttling device wherein a throttling device is positioned along the common refrigerant flow path portion when a single throttling device is used and a first throttling device is positioned along the first divergent flow path portion and a second throttling device is positioned along the second divergent flow path portion when two or more throttling devices are employed; a portioning device configured to selectively and proportionately regulate the flow of a refrigerant fluid to the first evaporator and the second evaporator, respectively;

wherein the compressor is configured to be capable of simultaneously driving both the first evaporator and the second evaporator at their full cooling capacity and wherein the first evaporator is positioned within a housing of a first indoor air unit positioned within the single living area of the building and the second evaporator is positioned within a housing of a second indoor air unit and both the first and second indoor air units each further comprise a fan configured to drive air across the first evaporator of the first indoor air unit and across the second evaporator of the second indoor air unit; and wherein the first evaporator is a disjointed evaporator and the second evaporator is a disjointed evaporator such that each indoor air unit is configured to control the ratio of the latent to sensible cooling capacity of the evaporator, fan speed, and proportional flow of refrigerant to different evaporator sections of the disjointed evaporators.

2. The split air conditioning system of claim 1 further comprising:

at least one temperature sensor in communication with a controller; and at least one humidity sensor in communication with the controller; and wherein the plurality of refrigerant conduits are free of any check valves;

wherein the portioning device is in communication with the controller; and wherein the fans are variable speed fans in communication with the controller.

3. The split air conditioning system of claim 2, wherein the, portioning device, the at least one humidity sensor and the at least one temperature sensor are in signal communication with the controller and controlled by the controller.

4. The split air conditioning system of claim 1, wherein the compressor is a compressor chosen from the group consisting of a variable capacity compressor and a dual suction compressor.

5. The split air conditioning system of claim 4, wherein the compressor is a dual suction compressor and the first divergent flow path portion and the second divergent flow path portion merge into the common refrigerant flow path portion within the dual suction compressor and each indoor air unit is configured to control temperature, humidity and airflow velocity output of the indoor air unit by controlling the cooling capacity of the evaporator, fan speed, and proportional flow of refrigerant to different evaporator sections of the disjointed evaporators.

6. The split air conditioning system of claim 4, wherein the first divergent flow path portion delivers refrigerant to the dual suction compressor via a first intake port of the dual suction compressor and the second divergent flow path portion delivers refrigerant to the dual suction compressor via a second intake port of the dual suction compressor and the dual suction compressor delivers a refrigerant to the common refrigerant flow path portion and the split air conditioning system comprises: a first throttling device where the first throttling device is positioned along the first divergent flow path portion and positioned to receive coolant from the condenser before the coolant is delivered to the first evaporator and a second throttling device where the second throttling device is positioned along the second divergent flow path portion and positioned to receive coolant from the condenser before the coolant is delivered to the second evaporator.

7. The split air conditioning system of claim 6, wherein the first and second throttling devices are each a capillary tube.

8. The split air conditioning system of claim 1, wherein the compressor is a single speed compressor and the fans are variable speed fans.

9. The split air conditioning system of claim 1, wherein the portioning device is a portioning device chosen from the group consisting of a three way solenoid valve and a stepper motor switching valve.

10. The split air conditioning system of claim 1, wherein the portioning device is a multi-port portioning valve.

11. The split air conditioning system of claim 1, wherein the first evaporator is associated with and positioned within a housing of a first indoor air treatment unit and the first indoor air treatment unit is positioned within the single living area to condition air in a first zone of the single living area and the second evaporator is associated with and positioned within a housing of a second indoor air treatment unit and the second indoor air treatment unit is positioned within the single living area to condition air in a second zone of the single living area.

12. The split air conditioning, system of claim 11, wherein the first zone and the second zone are volumes of air within a single room and the first indoor air treatment unit is configured to regulate both temperature and humidity within the first zone and the second indoor air treatment unit is configured to regulate both temperature and humidity within the second zone.

13. The split air conditioning system of claim 12, wherein the first indoor air treatment unit and the second indoor air treatment unit are each chosen from the group consisting of a floor standing indoor air treatment unit not connected to a wall and at occupant level and a wall mounted indoor air treatment unit.

14. The split air conditioning system of claim 13, wherein the first and second indoor air treatment units are both vertically oriented floor standing units that are either fixed or movable and both further comprise an air purification system configured to remove an air impurity chosen from the group consisting of dust, particulates, volatile organic compounds, and combinations thereof and wherein the split air conditioning system further comprises a heating element and are configured to provide heating to the single living area.

15. The split air conditioning system of claim 1, wherein each indoor air unit is configured to control temperature, humidity and airflow velocity output of the indoor air unit by controlling the ratio of the latent to sensible cooling capacity of the evaporator, fan speed, and proportional flow of refrigerant to different evaporator sections of the disjointed evaporators.

16. The split air conditioning system of claim 15, wherein the compressor is a variable capacity compressor.

17. A split air conditioning system for conditioning a plurality of zones within the same interior room of a building, the split air conditioning system comprising:

a single outdoor unit comprising:

a housing with a compressor; a condenser; and a condenser fan positioned within the housing wherein the condenser fan is associated with the condenser and configured to move air to cool the condenser and the compressor is a dual suction, variable speed compressor capable of and configured to deliver full cooling capacity to both a first evaporator and a second evaporator;

a refrigerant flow pathway comprised of a plurality of refrigerant conduits having a common refrigerant flow path portion and at least two divergent flow path portions, a first divergent flow path that delivers refrigerant to the first evaporator wherein the first evaporator is configured to operate at a first evaporator pressure and a second divergent flow path that delivers refrigerant to the second evaporator wherein the second evaporator is configured to operate at a second evaporator pressure and the first evaporator and second evaporator are in parallel with one another;

at least two throttling devices wherein a first throttling device is positioned along the first divergent flow path to receive refrigerant fluid prior to the first evaporator and a second throttling device is positioned along the second divergent flow path to receive refrigerant fluid prior to the second evaporator;

a first variable speed fan configured to move air across the first evaporator;

a second variable speed fan configured to move air across the second evaporator;

a portioning device configured to selectively and proportionately regulate the flow of a refrigerant fluid to the first evaporator and the second evaporator, respectively;

wherein the compressor is configured to be capable of simultaneously driving both the first evaporator and the second evaporator at their full cooling capacity and wherein the plurality of refrigerant conduits making up the refrigerant flow path are free of any check valves, and wherein the first evaporator is a disjointed evaporator and the second evaporator is a disjointed evaporator such that each indoor air unit is configured to control the ratio of the latent to sensible cooling capacity of the evaporator, fan speed, and proportional flow of refrigerant to different evaporator sections of the disjointed evaporators.

18. The split air conditioning system of claim 17, wherein the compressor is a variable capacity, dual suction compressor and the portioning device is a three way solenoid valve or a stepper motor valve and wherein the system further comprises:

a controller in communication with the portioning device to control the portioning device, at least one temperature sensor in communication with the portioning device and at least one humidity sensor in communication with the portioning device.

19. The split air conditioning system of claim 18, wherein the first evaporator is associated with and positioned within a housing of a first indoor air treatment unit and the first indoor air treatment unit is positioned within the same interior room and configured to condition air in a first zone of the same interior room and the second evaporator is associated with and positioned within a housing of a second indoor air treatment unit and the second indoor air treatment unit is positioned within the same interior room to condition air in a second zone of the same interior room and wherein the first evaporator and the first variable speed fan are configured to create and adjust a first zone size and a temperature within the first zone based upon user input into the controller or information received by the controller indicating the presence of a person within the first zone and wherein the second zone and the second variable speed fan are configured to create and adjust a second zone size and a temperature within the second zone based upon user input into the controller or information received by the controller indicating the presence of a person within the second zone and wherein each indoor air unit is configured to control temperature, humidity and airflow velocity output of the indoor air unit by controlling the ratio of the latent to sensible cooling capacity of the evaporator, fan speed, and proportional flow of refrigerant to different evaporator sections of the disjointed evaporators.

20. A method of conditioning the air within two zones of the same living area within an interior of a building comprising the steps of:

providing a single outdoor unit comprising:

a compressor; a condenser; and a condenser fan associated with the condenser that moves air to cool the condenser;

a refrigerant flow pathway comprised of a plurality of refrigerant conduits having a common refrigerant flow path portion and at least two divergent flow path portions, a first divergent flow path that delivers refrigerant to a first evaporator configured to operate at a first evaporator pressure and a second divergent flow path that delivers refrigerant to a second evaporator such that the first evaporator and second evaporator are in parallel with one another;

at least one throttling device wherein a throttling device is positioned along the common refrigerant flow path portion when a single throttling device is used and a first throttling device is positioned along the first divergent flow path and a second throttling device is positioned along the second divergent flow path when two or more throttling devices are employed; a portioning device configured to selectively and proportionately regulate the flow of a refrigerant fluid to the first evaporator and the second evaporator, respectively;

wherein the compressor is configured to be capable of simultaneously driving both the first evaporator and the second evaporator at their full cooling capacity and wherein the first evaporator is positioned within a housing of a first indoor air unit positioned within a single living area of the building and the second evaporator is positioned within a housing of a second indoor air unit and both the first and second indoor air units each further comprise a fan configured to drive air across the first evaporator of the first indoor air unit and across the second evaporator of the second indoor air unit;

adjusting the refrigerant flow through the first divergent flow path and the second divergent flow path using the portioning device, the compressor or both to independently change a cooling capacity of the first evaporator and the second evaporator;

adjusting a first variable speed fan to create and adjust a first zone size and a temperature within a first zone based upon user input into a controller or information received by the controller indicating the presence of a person within the first zone; and adjusting a second variable speed fan to create and adjust a second zone size and a temperature within a second zone based upon user input into the controller or information received by the controller indicating the presence of a person within the second zone, wherein the size of the first zone and the size of the second zone are substantially changed by changing the relative volume of air being moved by the first variable speed fan and the second variable speed fan.

21. The method of claim 20, wherein the first evaporator is a disjointed evaporator and the second evaporator is a disjointed evaporator such that each indoor air unit controls temperature, humidity and airflow velocity output of the first indoor air unit and the second indoor air unit by controlling the ratio of the latent to sensible cooling capacity of the evaporator, fan speed, and proportional flow of refrigerant to different evaporator sections of the disjointed evaporators.

* * * * *